US008919273B1

(12) United States Patent
Hoffman et al.

(10) Patent No.: US 8,919,273 B1
(45) Date of Patent: Dec. 30, 2014

(54) WALL-MOUNTED VALVE

(75) Inventors: Michael Hoffman, Greenwich, OH (US); Bradley N. Stoops, Bay Village, OH (US)

(73) Assignee: Sierra Lobo, Inc., Fremont, OH (US)

( * ) Notice: Subject to any disclaimer, the term of this patent is extended or adjusted under 35 U.S.C. 154(b) by 232 days.

(21) Appl. No.: 13/442,361

(22) Filed: Apr. 9, 2012

(51) Int. Cl.
*B63G 8/00* (2006.01)

(52) U.S. Cl.
USPC ..... 114/312

(58) Field of Classification Search
CPC ..... B63B 13/00; B63B 13/02; B63B 2770/00
USPC ..... 137/899, 899.2, 360, 560; 251/321, 251/322, 144; 114/183 R, 197, 312
See application file for complete search history.

(56) References Cited

U.S. PATENT DOCUMENTS

| | | | | |
|---|---|---|---|---|
| 3,563,267 | A * | 2/1971 | Thompson | 137/329.1 |
| 4,198,918 | A * | 4/1980 | Patriarca et al. | 114/197 |
| 4,846,209 | A * | 7/1989 | Martini | 137/68.13 |
| 4,986,777 | A * | 1/1991 | Preston | 440/88 L |
| 5,385,108 | A * | 1/1995 | Thompson | 114/183 R |
| 6,904,858 | B2 * | 6/2005 | Pastore | 114/125 |

* cited by examiner

*Primary Examiner* — Lars A Olson
*Assistant Examiner* — Anthony Wiest
(74) *Attorney, Agent, or Firm* — Pearne & Gordon LLP

(57) ABSTRACT

A valve is disclosed. The valve can be mounted through a wall, for example in the hull wall of a submersible vehicle. The internal components of the valve can be readily removed, serviced and/or replaced without removing the valve body from the wall. A filling assembly is also disclosed, which mates with the valve to deliver a fluid from one side of the wall, through the valve and into a storage tank or other apparatus disposed on the opposite side of the wall. The filling assembly actuates the valve to open a fluid pathway therethrough in order to deliver fluid to a storage tank or other apparatus connected to the valve's exit port.

24 Claims, 13 Drawing Sheets

WALL-MOUNTED VALVE

BACKGROUND OF INVENTION

1. Field of Invention

The invention relates to a valve mounted through the wall of an enclosure. In particular embodiments, it relates a valve mounted through the hull of a submersible vehicle for delivery of a fluid to a storage tank within the vehicle.

2. Description of Related Art

It is sometimes desired to house fluid-storage tanks within a sealed enclosure. The enclosure is formed by a wall or walls that surround(s) and contains those tanks. In the case of a submersible vehicle, the enclosure is the vehicle hull. The enclosure (e.g. hull) isolates the within environment from the outside environment and protects the tanks and any other components disposed within. For example, it may be desirable to draw and maintain a vacuum within the enclosure in order to thermally isolate the enclosed tanks and other components, to regulate its buoyancy and/or to minimize the apparatus's overall mass.

A conventional unmanned submersible vehicle receives its electrical power from onboard batteries. However, batteries possess a relatively-limited charge time meaning the vehicle has to be frequently recovered and its batteries recharged. It would be desirable to replace the batteries with a hydrogen/oxygen fuel cell, which would necessitate onboard stores of hydrogen and oxygen. It also may be desirable to store other fluids onboard a submersible vehicle, manned or unmanned, or in other types of enclosures whose interior environments it is desired to control or isolate. Internal storage tanks may be provided for this purpose, which may contain compressed atmospheric gases, potable water or other liquids useful for a variety of purposes including for life support, as fuels, or as other materials useful to sustain the apparatus, its occupants or its mission. In certain applications, the tanks can contain cryogenic liquids (such as liquid hydrogen, oxygen, helium or other cryogens), which can be used as life-support gases after being heated and vaporized to their gaseous state, or as fuels for propulsion or for electric-generation equipment such as an onboard hydrogen/oxygen fuel cell.

It would be desirable to replenish such a storage tank within a sealed enclosure, such as a submersible-vehicle hull, without exposing the interior environment of the enclosure to the exterior environment. In particular, it would be desirable that the state of the environment within the enclosure (e.g. a vacuum, a specified or regulated pressure of an inert gas, etc.) not be disturbed in order to replenish a storage tank located inside the enclosure.

SUMMARY OF INVENTION

A valve is disclosed. The valve includes a valve body having a valve-body bore and a component cartridge removably installed in the valve-body bore. The component cartridge is actuable to reversibly open and close a fluid pathway for transport of fluid through the valve. The component cartridge is actuable by a plunger that engages the cartridge via a valve inlet port from outside the valve.

A wall is also disclosed. The wall has first and second wall surfaces on opposite first and second sides of the wall. A wall bore is disposed in the wall between and open to the first and second wall surfaces. A valve is installed in the wall bore. The valve includes an inlet port accessible from the first side of the wall and an exit port accessible from the second side of the wall. The valve has an inlet port accessible from the first side of the wall and an exit port accessible from the second side of the wall. The valve is fully recessed within the wall bore on the first side of the wall so that no portion thereof extends above the first wall surface. The valve is actuable through the inlet port to reversibly open and close a fluid pathway for transport of fluid through the valve.

A filler apparatus for delivering a fluid to a valve is also disclosed. The apparatus includes a fill tube having a terminal end configured to mate with a valve to deliver a fluid to an inlet port of the valve. A plunger extends within the fill tube and has a terminal end that emerges from a terminal end of the fill tube. The plunger is actuable to control a degree to which the plunger's terminal end emerges from the fill tube's terminal end. A positioning nut is fitted to the fill tube and configured to secure the fill tube terminal end to a valve in order to deliver a fluid to the valve.

A submersible vehicle is disclosed. The vehicle includes a hull having a hull wall with inner and outer wall surfaces on opposite sides of the wall. A wall bore is provided in the wall extending between and open to the inner and outer wall surfaces. A valve is installed in the wall bore. The valve has an inlet port accessible through the wall bore from outside the hull and an exit port accessible from inside the hull. The valve is recessed in the wall bore so that the valve does not extend above the outer wall surface. The valve is actuable through the inlet port to reversibly open and close a fluid pathway for transport of fluid through the valve.

A method of replenishing a fluid in a submersible vehicle is also disclosed, which includes the following steps: retrieving the submersible vehicle from a fluid in which the vehicle was submerged; delivering a fluid to the submersible vehicle via a valve secured in a hull wall of the vehicle and recessed beneath an outer surface of the hull wall without disturbing an interior environment within the hull and without exposing the interior environment to an exterior environment outside the hull.

SUMMARY OF DRAWING FIGURES

Figure 4:
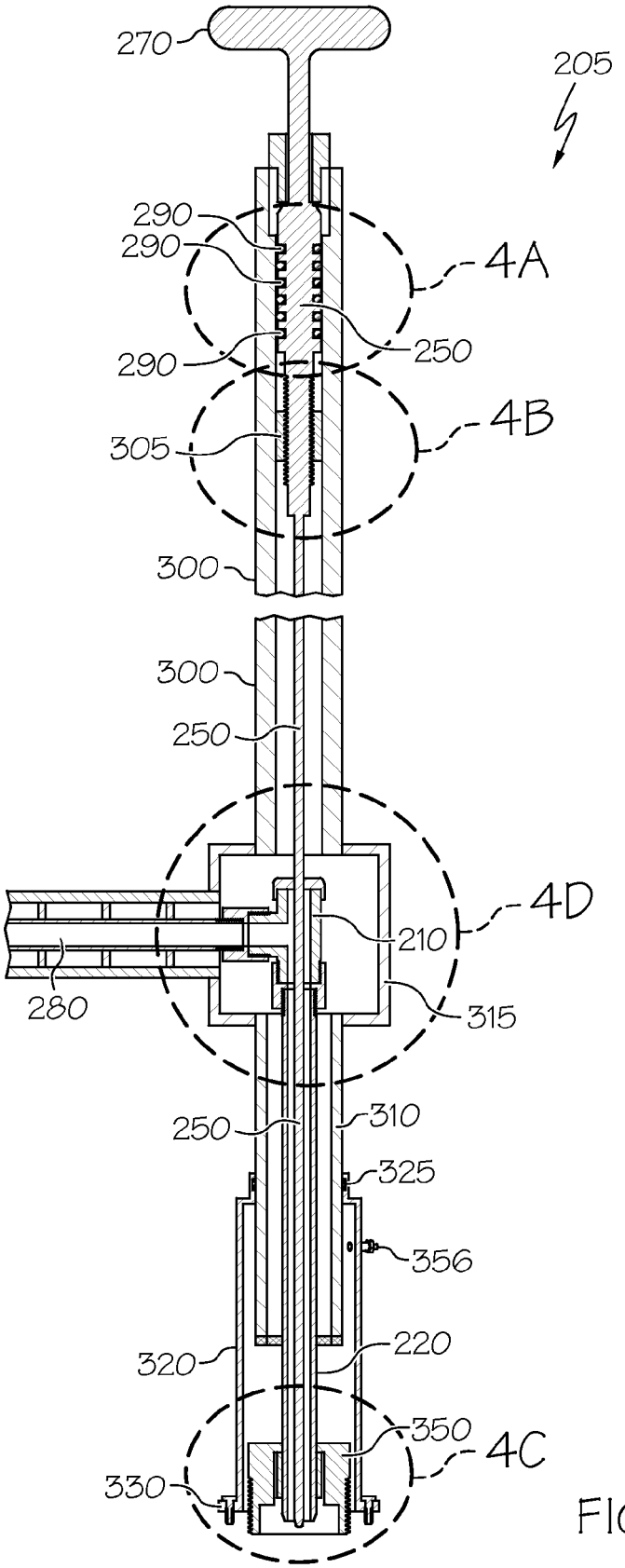
FIG. 4 is a side cross-sectional view of a filling assembly that can mate with a valve as disclosed herein for delivery of a fluid.
Figure 4A:
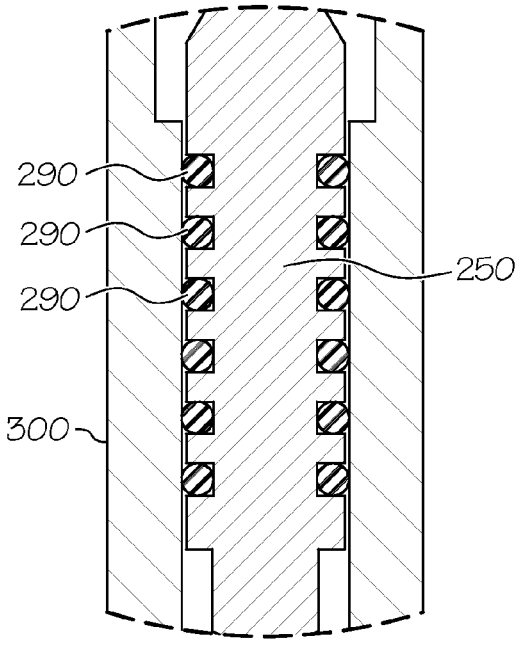
Figure 4B:
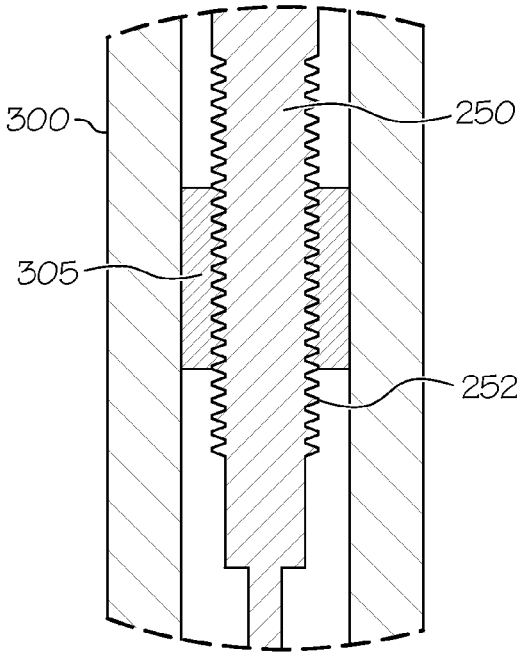
Figure 4C:
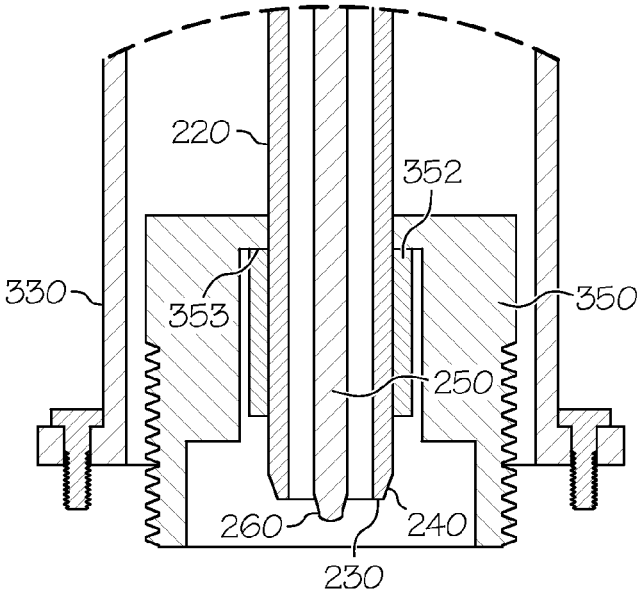
Figure 4D:
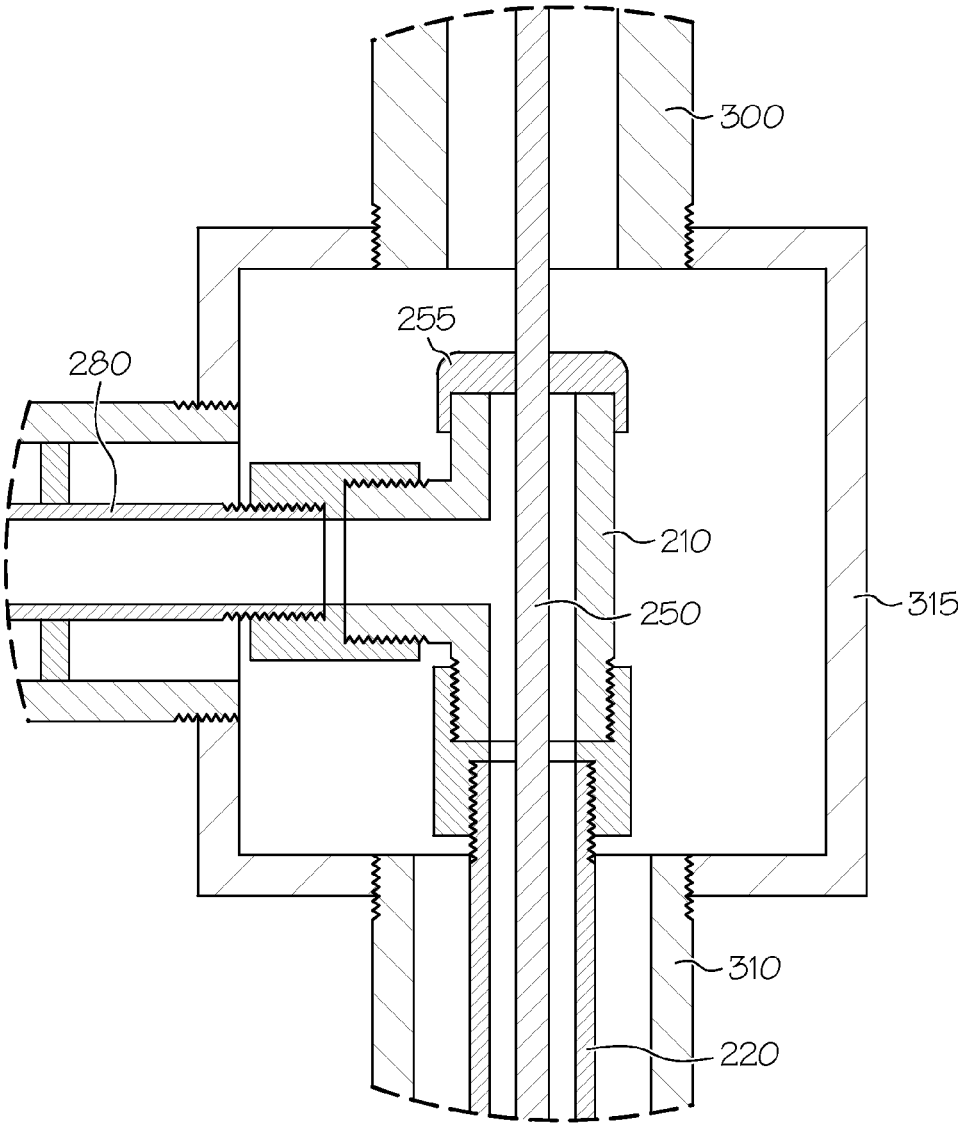
Figure 4E:
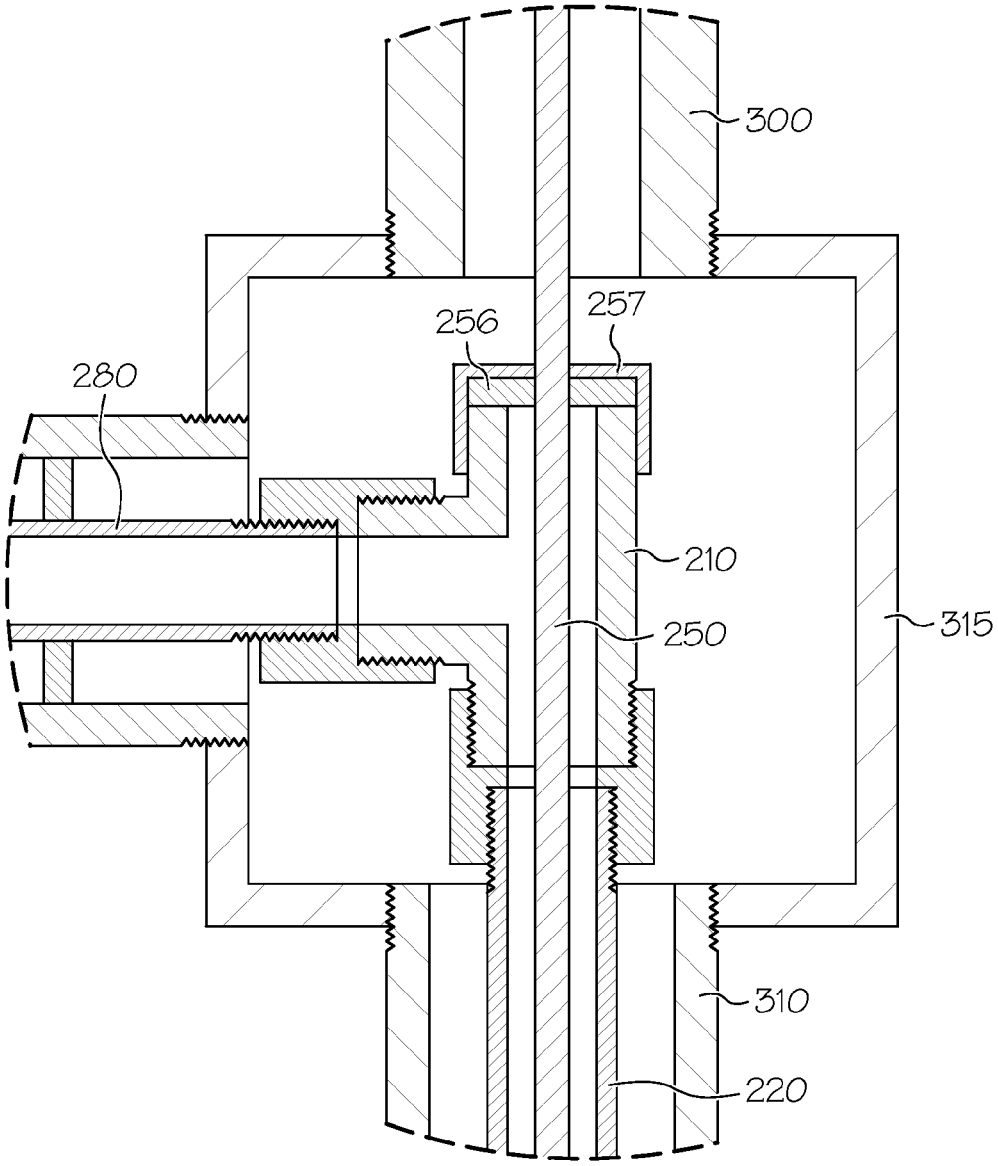

FIGS. 4A-4E are close-up cross-sectional views of the filling assembly in FIG. 4 as indicated in FIG. 4. FIGS. 4D and 4E illustrate alternative embodiments of providing a seal with the plunger 250 so that fluid does not penetrate past the plunger 250 past the upper vertical branch of the tee 210, into the plunger sleeve 300.

Figure 5:
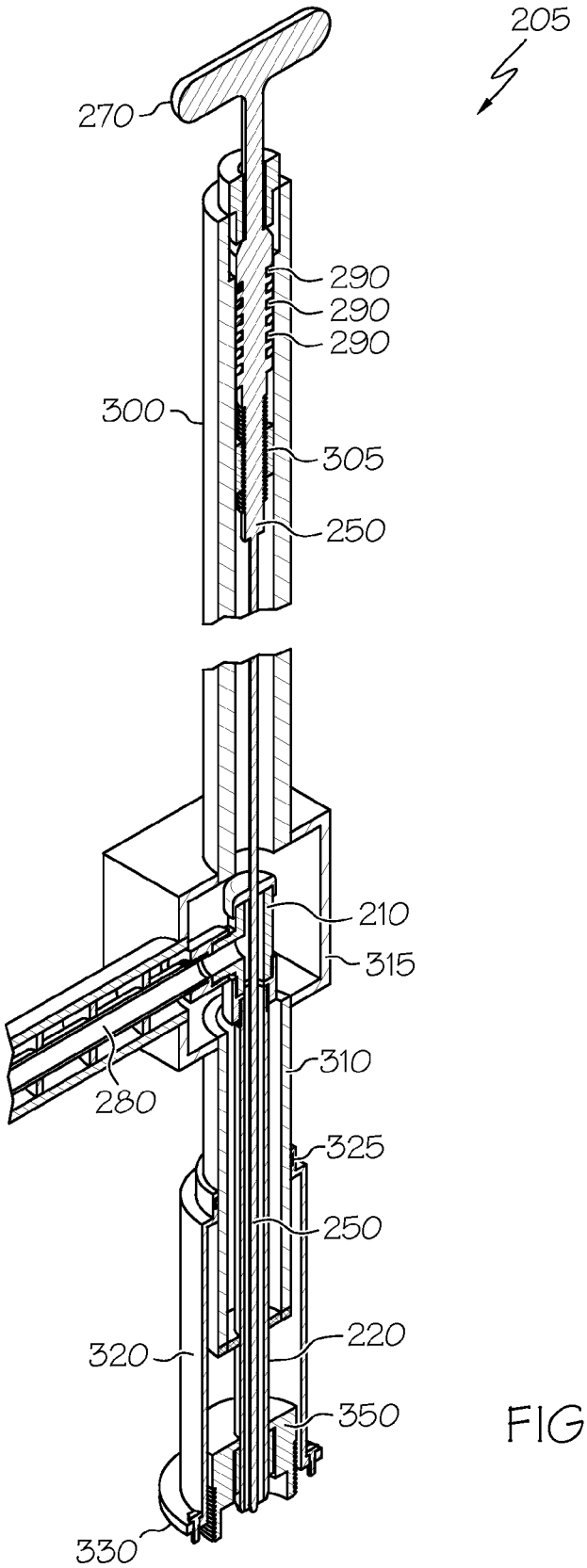

FIG. 5 is a partially broken-away perspective view of the filling assembly of FIG. 4.

Figure 2A:
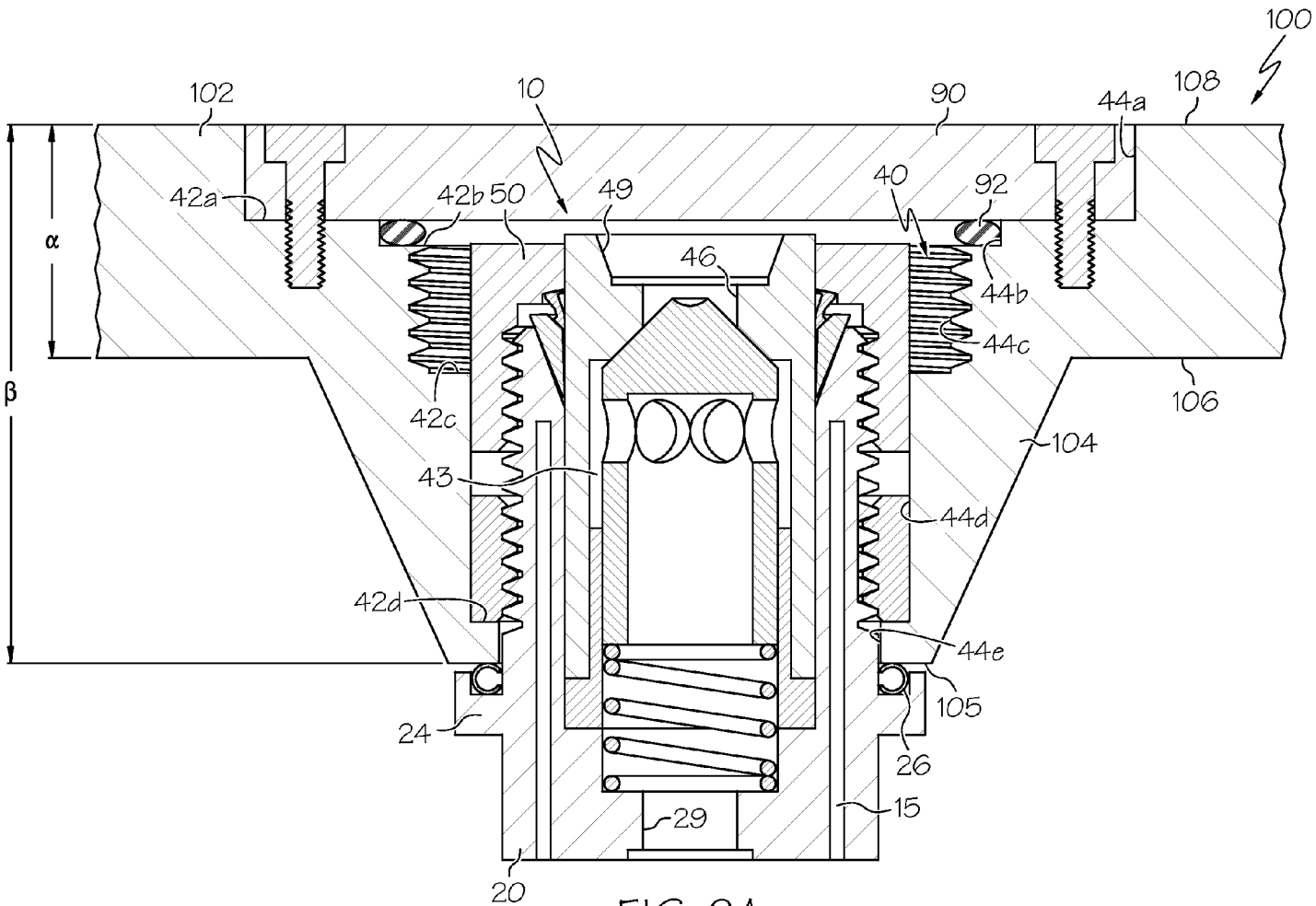
FIG. 2A is cross-sectional view of a valve according to a first embodiment mounted a wall, taken along line 2A-2A in FIG. 1B.
Figure 6A:
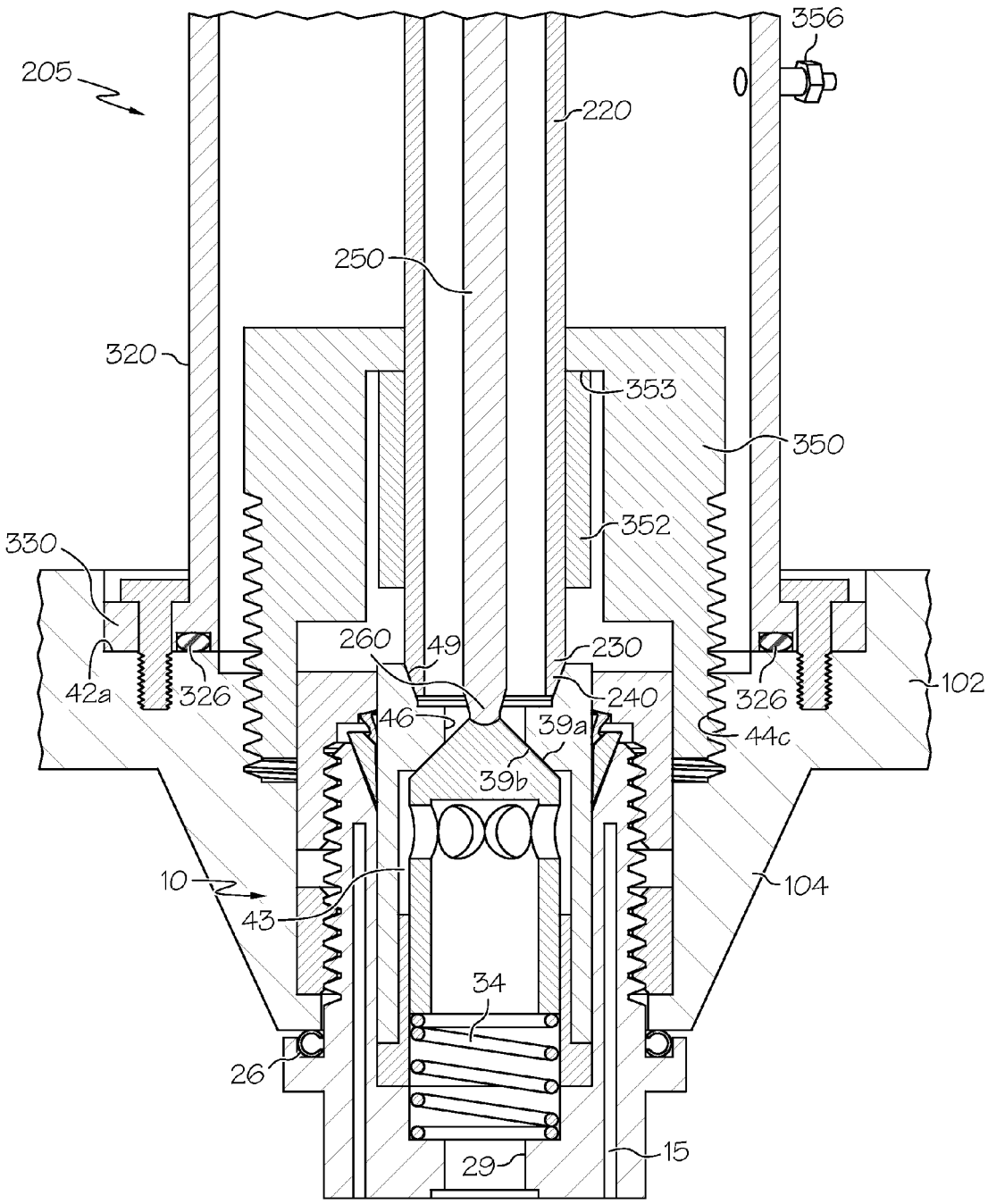
Figure 6B:
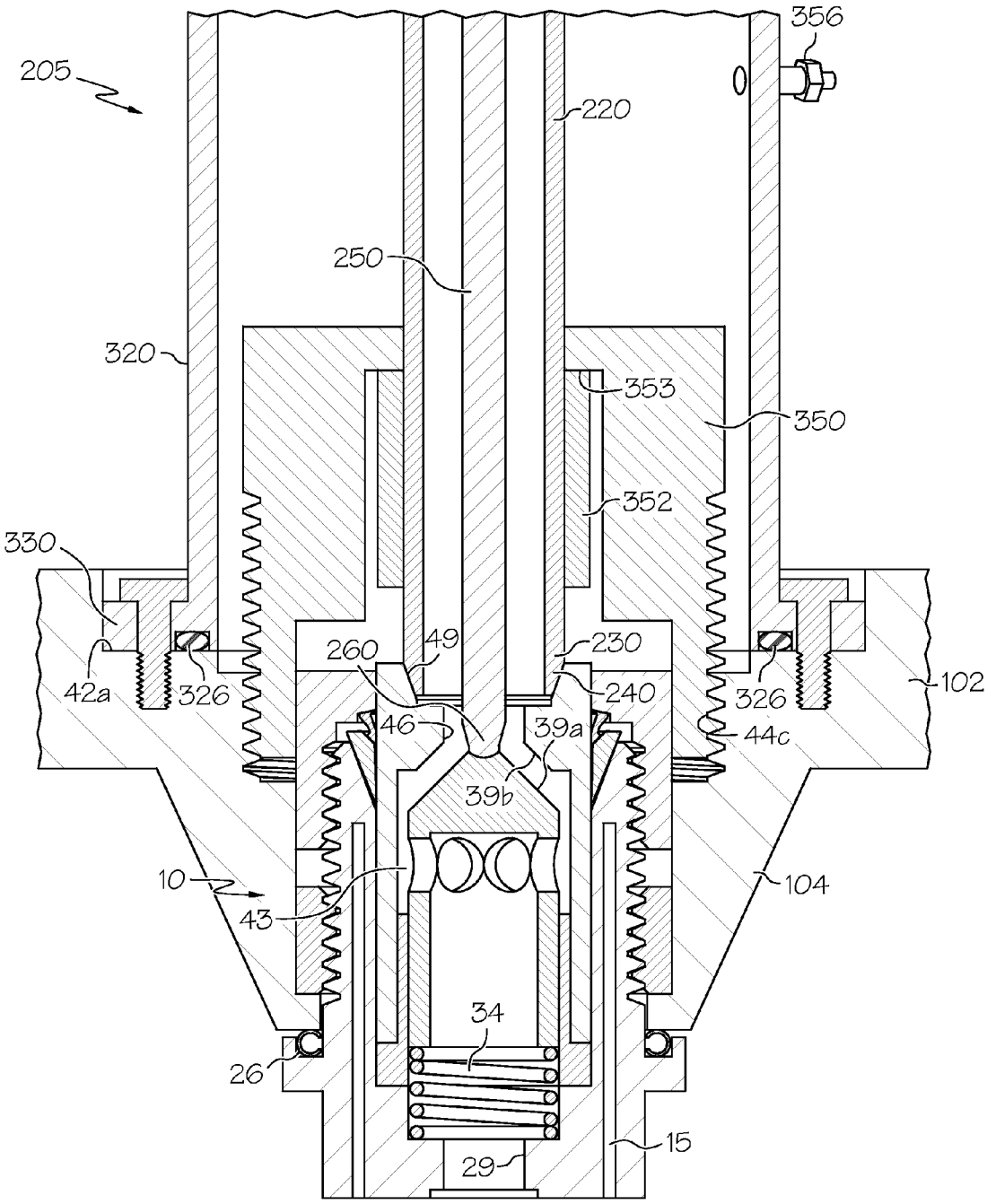

FIGS. 6A-6B are side cross-sectional views of the valve in FIG. 2A but having the filling assembly of FIG. 4 mated thereto for delivery of a fluid. In FIG. 6A, the plunger 250 contacts the engagement portion of the poppet 36 in the closed position. In FIG. 6B, the plunger 250 has pressed against the poppet 36 so that the poppet 36 is in the open position.

DETAILED DESCRIPTION OF PREFERRED EMBODIMENTS

Figure 1A:
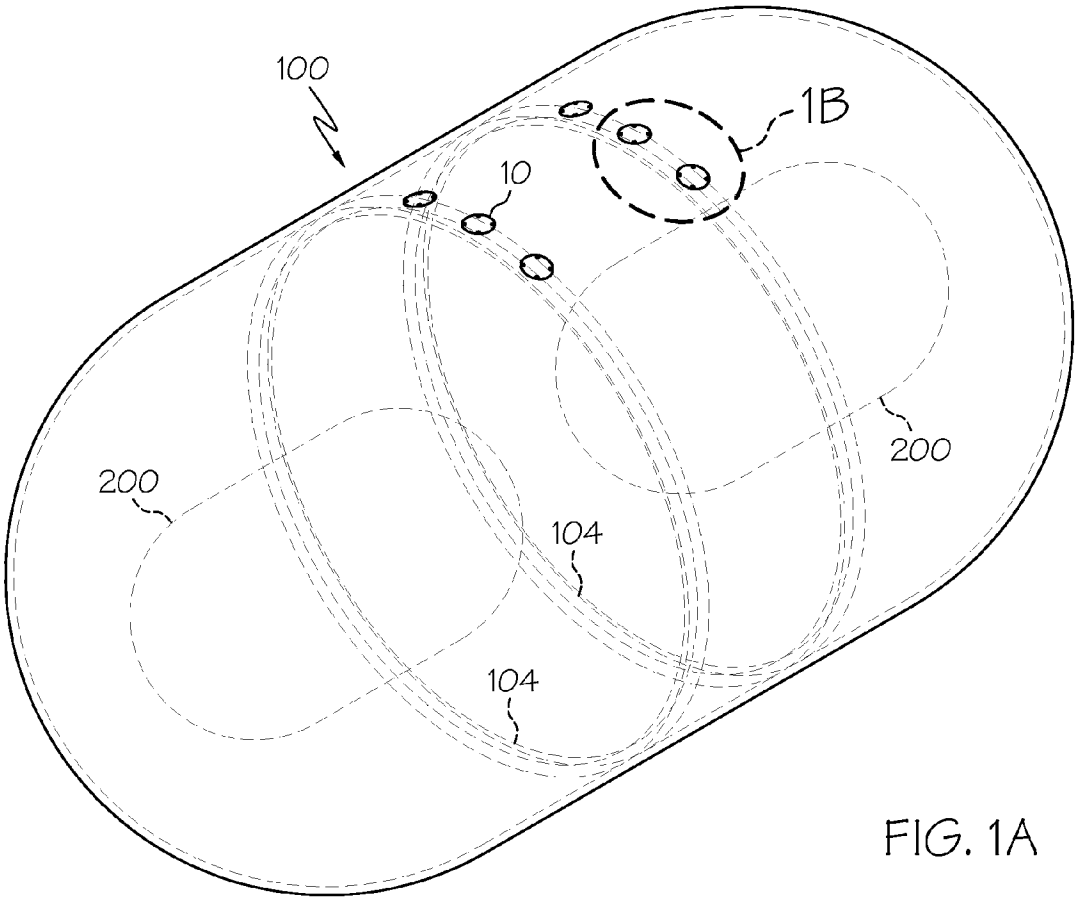
FIG. 1A is a perspective schematic view of an enclosure, such as a vehicle hull, having a plurality of valves as herein described mounted in a wall thereof.

Referring first to FIG. 1A, an enclosure 100 is shown. The enclosure includes a number of storage tanks 200 therein, which can contain a variety of fluids. For example, in one embodiment the enclosure 100 represents the hull of a submersible undersea vehicle having an onboard hydrogen and oxygen fuel cell (not shown) for generating the electricity used to operate the vehicle's systems. The hull 100 typically is made from aluminum, e.g. 6061 Al, which is resistant to corrosion from seawater. In this embodiment, the storage tanks 200 can be used to contain either liquid hydrogen or liquid oxygen, which are consumed by the fuel cell in generating electricity. The remainder of the description will be presented assuming the enclosure 100 is the hull of such an undersea vehicle. However, it will be appreciated that this is merely one exemplary embodiment of an enclosure that may be fitted with and served by the valves 10 that are hereafter described. Such valves can be readily adapted to and installed in the enclosures of any number of other apparatus wherein it is desired to provide through-the-wall transport of a fluid without compromising the interior environment of the enclosure. Similarly, features of the hull that are hereafter described likewise can be adapted to and provided in the enclosures for other apparatus in conjunction with or to accommodate the provision of a valve 10 therein. Accordingly, it will be appreciated that the terms "enclosure" as used above and "hull" as used below may be used interchangeably for purposes of describing and understanding the valves 10 herein described and their fitment in the wall of an enclosure, with the only distinction being that "hull" refers to the specific enclosure of a submersible vehicle.

Figure 1B:
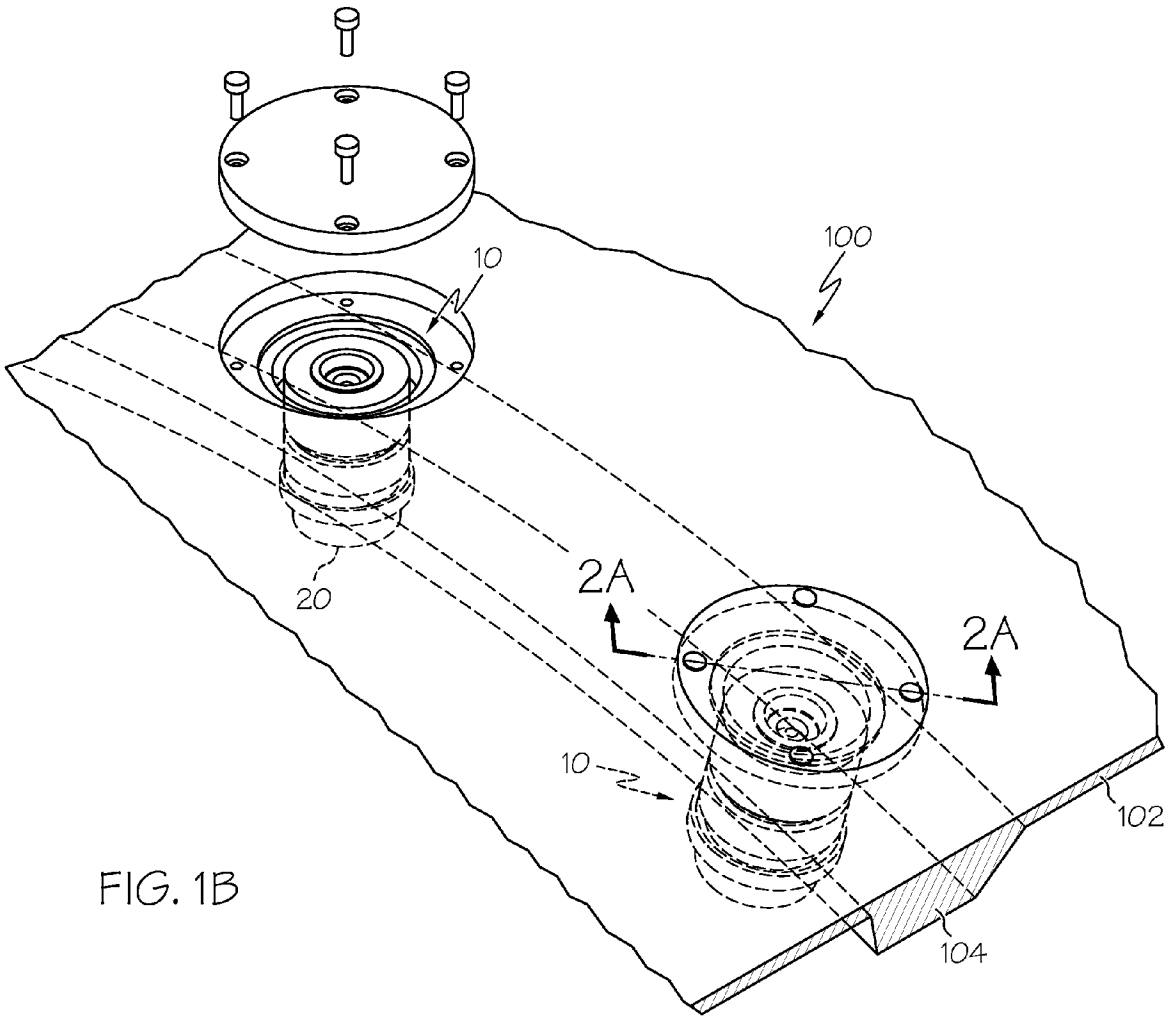
FIG. 1B is a close-up view of the enclosure wall in FIG. 1A showing a plurality of valves therein through a portion of the wall having a rib as hereafter described.
Figure 2B:
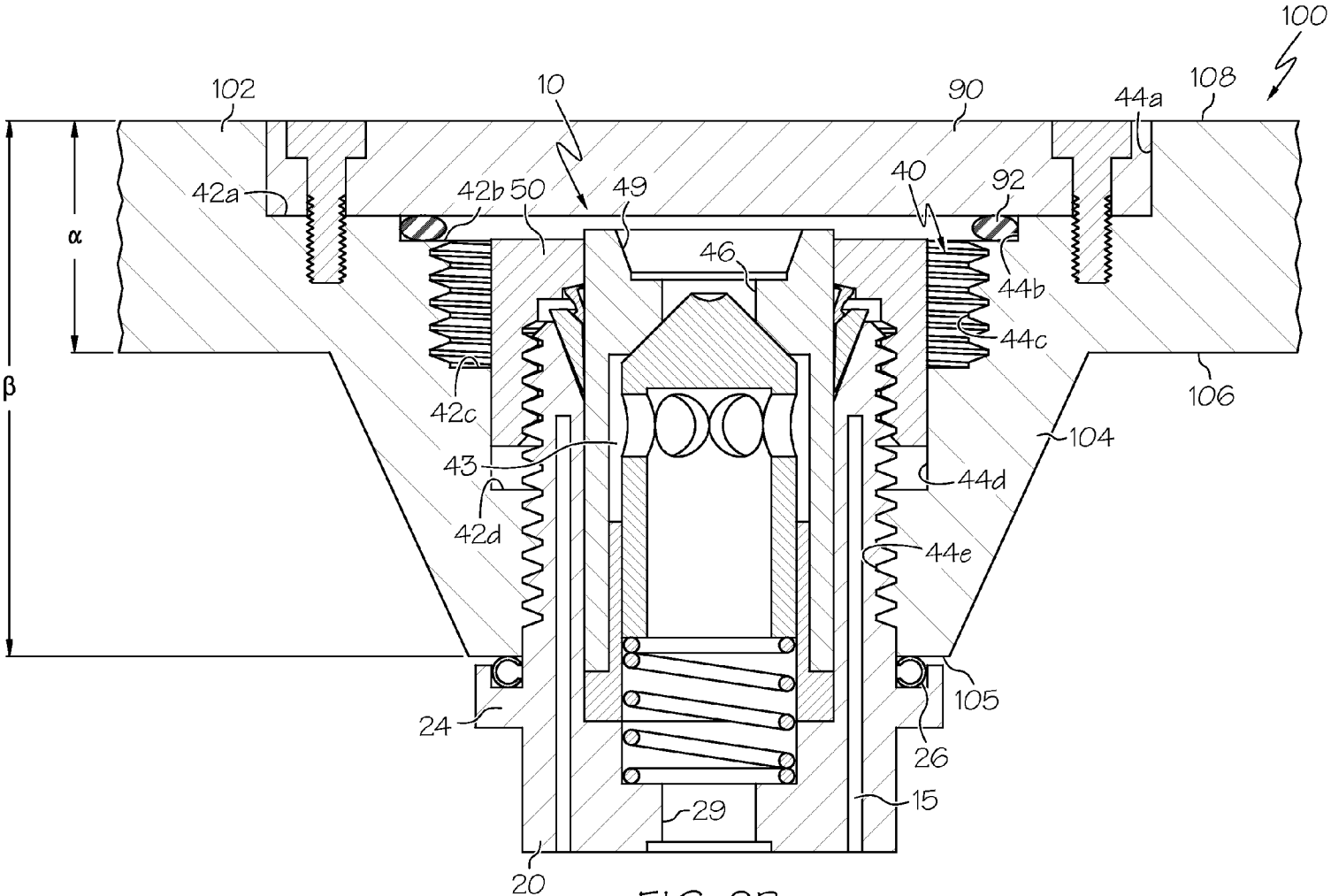
FIG. 2B is cross-sectional view of a valve similar to that in FIG. 2A, but showing a second embodiment.

Returning to FIG. 1A and further referring to FIGS. 2A-2B, the hull 100 is made up of a wall 102 (or a plurality of cooperating walls) that enclose(s) a volume therein. The hull wall 102 typically has a primary thickness, $\alpha$, which is prevalent over the major expanse of the hull 100. The primary thickness can be selected based on the hull's material of construction and its desired strength in view of its known or anticipated in-service conditions. For a submersible vehicle whose hull is made of aluminum, $\alpha$ is preferably not more than 0.35 inches for a vehicle having an in-service depth not exceeding 1,000 feet (greater thicknesses will be desirable for greater in-service depths). The hull 100 also can have one or a plurality of ribs 104 extending above the major expanse of the interior surface 106 of the wall 102, or the expanse of the interior surface 106 located adjacent the rib 104, into the interior volume enclosed by the hull 100. The ribs 104 preferably are formed integrally with and as part of the hull wall 102 such that the local thickness, $\beta$, of the wall 102 at the location of rib 104 is greater than the primary wall thickness, $\alpha$. In a submersible-vehicle hull 100 having a cylindrical wall 102 (as seen in FIG. 1A-1B) the ribs 104 are circular, projecting radially inward from the inner surface 106 of wall 102 toward the longitudinal axis of the cylindrical wall.

When present, each rib 104 provides structural reinforcement to the hull 100 in the vicinity of the rib 104. In preferred embodiments (and as best seen in FIGS. 2A-2B), the rib has a tapered cross-section (taken along a plane that bisects the cylindrical wall 102 along its axis) that is widest at its base where the rib 104 protrudes from the inner surface 106 of the wall 102, and narrows as the rib 104 projects radially inward and away from the wall 102. Such a configuration lends additional reinforcement to the hull 100 in the vicinity of the rib 104, and also strengthens the rib 104, which is desirable particularly in locations where a portion of the rib 104 is to be hollowed out to accommodate a valve 10 therein as described below. In the figures the rib 104 is illustrated having a trapezoidal cross-section.

In FIGS. 2A-2B, a valve 10 is installed through wall 102 at the location of a rib 104, such that the valve 10 is recessed beneath the outer surface 108 of the wall 102. In a submersible vehicle, such a rib 104 provides a desirable location to install the valve 10. This is because the wall thickness, $\beta$, at that location can accommodate the depth of the valve 10 and still house it within the wall while the remainder of the hull wall 102 can retain a relatively lower thickness, $\alpha$, which may be desirable, e.g. to conserve weight. The remainder of the description will be provided in relation to an embodiment wherein a valve 10 is installed in a wall 102 at the location of a rib 104, wherein the ribbed portion of the wall 102 possesses additional thickness compared to adjacent portions of the wall 102 sufficient to accommodate the valve 10 therein. However, it will be appreciated that this is one exemplary embodiment, and the valve 10 as hereafter described can be similarly installed in a wall of uniform thickness sufficient to accommodate the valve 10 therein. Alternatively, the valve 10 can be installed in a relatively thin wall at a location where at least a portion thereof possesses a greater thickness sufficient to accommodate the valve 10; e.g. at a location where the wall has a boss protruding above a surface thereof, which boss can be dimensioned specifically to accommodate the valve 10 at a specific location. The boss can be formed integrally with the wall, or it may be separately provided and permanently adhered to a surface of the wall. Features provided in a rib 104 as hereafter described (e.g. a stepped bore 40) to accommodate the valve 10 can likewise be provided in a wall of uniform thickness or in a portion thereof of relatively greater thickness sufficient to accommodate the valve.

Returning to FIGS. 2A-2B, to accommodate installation of the valve 10 a bore 40 can be provided through the wall 102, including through the rib 104. The bore 40 preferably has a plurality of steps (referred to herein as a 'stepped bore') defining corresponding shoulders 42*a-d* at successively increasing depths measured from the outer surface 108 of the wall 102. Correspondingly, the bore 40 has a plurality of discrete side walls 44*a-e* having respectively decreasing inner diameters following each successive step (shoulder 42*a-d*) going from the outer surface 108 to the inner surface 106 (e.g. inward terminal surface of the rib 104). In the embodiment shown in FIG. 2A, the side wall 44*e* is smooth and the valve body 20 is secured in the hull wall 102 via a separate female-threaded locking nut 28 as described below. In the alternative embodiment shown in FIG. 2B, the side wall 44*e* that defines the smallest bore (through bore) at the center of the stepped bore 40 is internally female-threaded to secure the valve body 20 thereto, also described below.

The description in the preceding paragraph referring to a single stepped bore 40 is merely for simplicity; the same structure could be equally described as a plurality of successively-narrower partially-blind bores, each having its own inner diameter and depth, with a smaller through-bore at the center. The stepped bore 40 can be provided in wall 102 by first boring fully through the thickness of the wall 102 (including rib 104) at a diameter equal to that of the smallest side wall (44*e*) shown in FIGS. 2A-2B. Thereafter, successively larger partially-blind bores can be provided by boring through from the outer surface 108 to the appropriate depths corresponding to each of the shoulders 42*d*, 42*c*, 42*b* and lastly, 42*a*. The depths of shoulders 42*a-d* and diameters of side walls 42*a-e* are selected to accommodate the valve 10 structure, cover plate 90 and cover gasket 92 (which can be an O-ring) when assembled together, as will be further described.

Figure 3A:
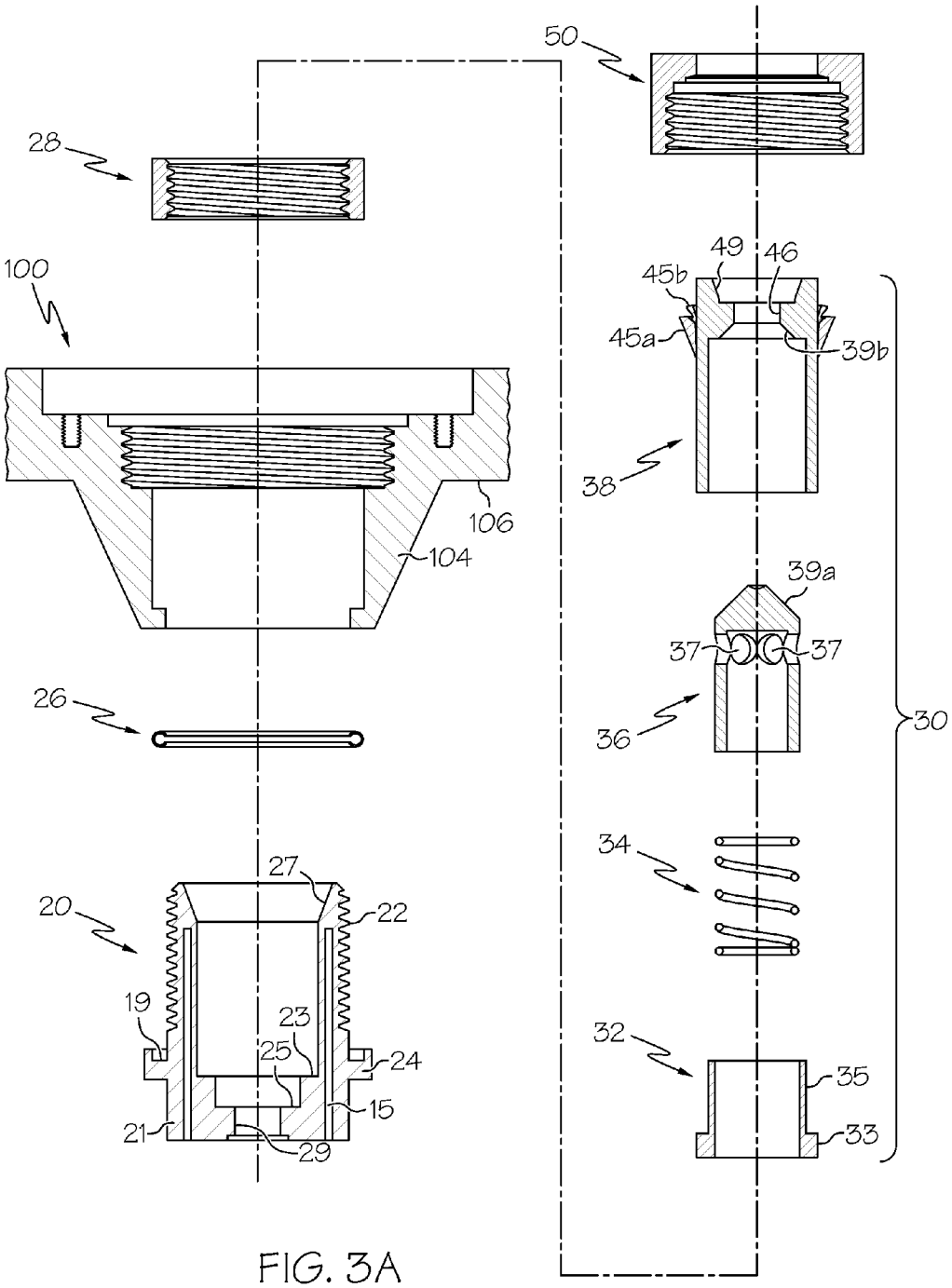
FIG. 3A is a centerline exploded view of the valve and wall according to the embodiment shown in FIG. 2A.

Referring now to FIGS. 2A and 3A, the valve 10 includes a valve body 20 having a valve-body bore that is dimensioned to receive and accommodate the internal valve components. The valve body 20 is preferably a substantially cylindrical body whose outer diameter is dimensioned to correspond substantially to the inner diameter of side wall 44*e* that defines the small through bore at the center of the stepped bore 40. Optionally, the valve body 20 may include an annular evacuable space 15 in the side wall thereof generally surrounding a valve-body bore and open to the bottom surface of the valve body 20. In use, this space 15 may be evacuated, e.g., in communication and together with the interior environment of a hull 100 in which the valve 10 is installed, to provide a layer of vacuum insulation surrounding the internal components of the valve. This may be desirable when the valve 10 will be used to transport cryogenic fluids. In a preferred embodiment, the outer surface 22 of the valve body 20 is male-threaded from the top end of the body 20 downward along a portion of its length. The valve body 20 has a flange 24 extending radially from the outer surface 22 thereof at a location adjacent the bottom end of the valve body 20. The flange 24 preferably has a circular groove 19 in an upper surface thereof to accommodate a valve-body seal 26 (e.g. C seal as described below or an O-ring), which in use is compressed between the valve-body flange 24 and a mating surface 105 at the inward terminal end of the rib 104 in wall 102 as described below.

To install the valve 10, the valve body 20 is first inserted through the bore 40 in wall 102 from its inner surface 106. In the embodiment of FIGS. 2A and 3A, the outer wall 22 of the valve body 20 is slidably-received in the through bore defined by the side wall 44*e* at the center of the stepped bore 40. The diameters of the side wall 44*e* and the outer surface 22 of the valve body preferably complement one another to ensure a smooth, slidable engagement. The lower end of the valve body 20 has a plurality of opposed lateral flat portions (e.g. a hex head 21), which can be engaged by a conventional wrench to tighten the valve body 20 as will be further described. As mentioned above, a valve-body seal 26 preferably is seated in the circular groove 19 recessed in the upper surface of the valve body flange 24. The seal 26 protrudes above the upper surface of the flange 24 so that it will engage and be compressed against the mating surface 105 at the inward terminal end of the rib 104 as the valve body 20 is tightened.

Still referring to FIGS. 2A and 3A, the valve body 20 is inserted into the bore 40 until the seal 26 reaches and contacts the mating surface 105. A locking nut 28 is inserted into the bore 40 from the outer surface 108 of the hull wall 102 to engage the male threads on the valve body 20 protruding into the bore 40. The locking nut 28 has female threads that receive and cooperate with the complementary male threads on the outer surface 22 of the valve body 20. The locking nut 28 is tightened down over the male-threaded valve body 20 until the nut 28 abuts a step (illustrated as step 42*d* in FIG. 2A) of the bore 40. The nut 28 is tightened against the step (42*d*) to compress the valve-body seal 26 between the flange 24 and mating surface 105 in order to provide a desired fluid-tight seal between the valve body 20 and the wall 102. The locking nut 28 can have any suitable or conventional structure to enable it to be tightened using conventional tools. For example, it can be a hex nut, which can be tightened using a conventional hex-socket wrench. In such an embodiment, the side wall 44*c* preferably will extend to a sufficient depth (not shown) so that there is clearance between the lateral walls of the locking nut 28 and the bore 40 to accommodate the socket wrench. Alternatively, the locking nut 28 may incorporate engagement structure (such as pin sockets or other patterned socket(s)—such as a sinusoid pattern) in the upper surface thereof, wherein a corresponding tool (e.g. having complementary pins or other protruding pattern) can be used to tighten the locking nut 28 from above. In this embodiment, engagement of the nut 28 from the side is not required and the step 42*c* can be located above the locking nut 28 such that side wall 44*d* extends the full length of the locking nut 28 (as seen in the figures), thereby providing minimal clearance lateral to the locking nut 28. When tightening the locking nut 28 over the valve body 20, it will be desirable to engage the valve body 20, e.g. using a wrench to secure the hex head 21, in order to fix it against rotation as the locking nut 28 is tightened.

In a less preferred embodiment, the locking nut 28 may be pre-welded within the bore 40 so that tightening requires rotation of the valve body 40 relative to the rotationally-fixed locking nut 28. This embodiment may be undesirable in high-pressure or fatigue applications, e.g. where cryogenic temperatures will be cyclically encountered, because welding may tend to fatigue the metal of the hull wall 102 in the local vicinity.

The seal 26 is made of a compressible or resilient material that, in preferred embodiments, will be effective to provide a leak-tight seal between the opposing surfaces of the flange 24 and mating surface 105. When the valve 10 will experience cryogenic temperatures in service, it is preferred that the valve-body seal 26 is a resilient metal C seal as seen in FIGS. 2A-2B, which is available, e.g., from Ameriseal, Orange, Conn. Preferably the C seal is made a Tefloe-coated inconel spring in a Teflon®-coated inconel C-shaped housing. A metal C seal will better withstand and maintain a reliable seal under cryogenic conditions than other conventional seal materials. Alternatively, the seal 26 can be a more conventional O-ring or gasket-type seal made from a polytetrafluoroethylene (PTFE) material or a polyimide material capable of remaining stable across a range of temperatures down to, e.g., −273° C. to −150° C. A variety of such materials and gaskets made therefrom are available under the brand names Teflon® and Kapton® from DuPont. Such materials, as well as the metal C seals discussed above, can account for unmatched thermal expansion between the materials of construction for the hull 100 and the valve body 20, which are typically aluminum and stainless steel, respectively. While a metal C seal or a PTFE O-ring or gasket is preferred for the seal 26, particularly in cryogenic service, other suitable materials also may be used noting that the selection thereof will depend on the anticipated in-service conditions, which selection can be made by a person of ordinary skill in the art. For example, the seal 26 can be made of other natural or synthetic rubber materials.

As will be appreciated from FIG. 1A, the inward terminal surface of the rib 104 typically will have a radius of curvature based on the radius of the circumferential wall of the hull. It may be challenging to seal a gasket against such a curved surface depending on the size of the hull 100 and therefore its radius of curvature. Therefore, the mating surface 105 may be provided as a flat (e.g. circular) surface machined into the inward terminal surface 104 of the rib (e.g. recessed slightly therein) at locations where valves 10 are to be installed. Thus, the seal 26 will have a flat mating surface 105 against which to form a seal.

Figure 3B:
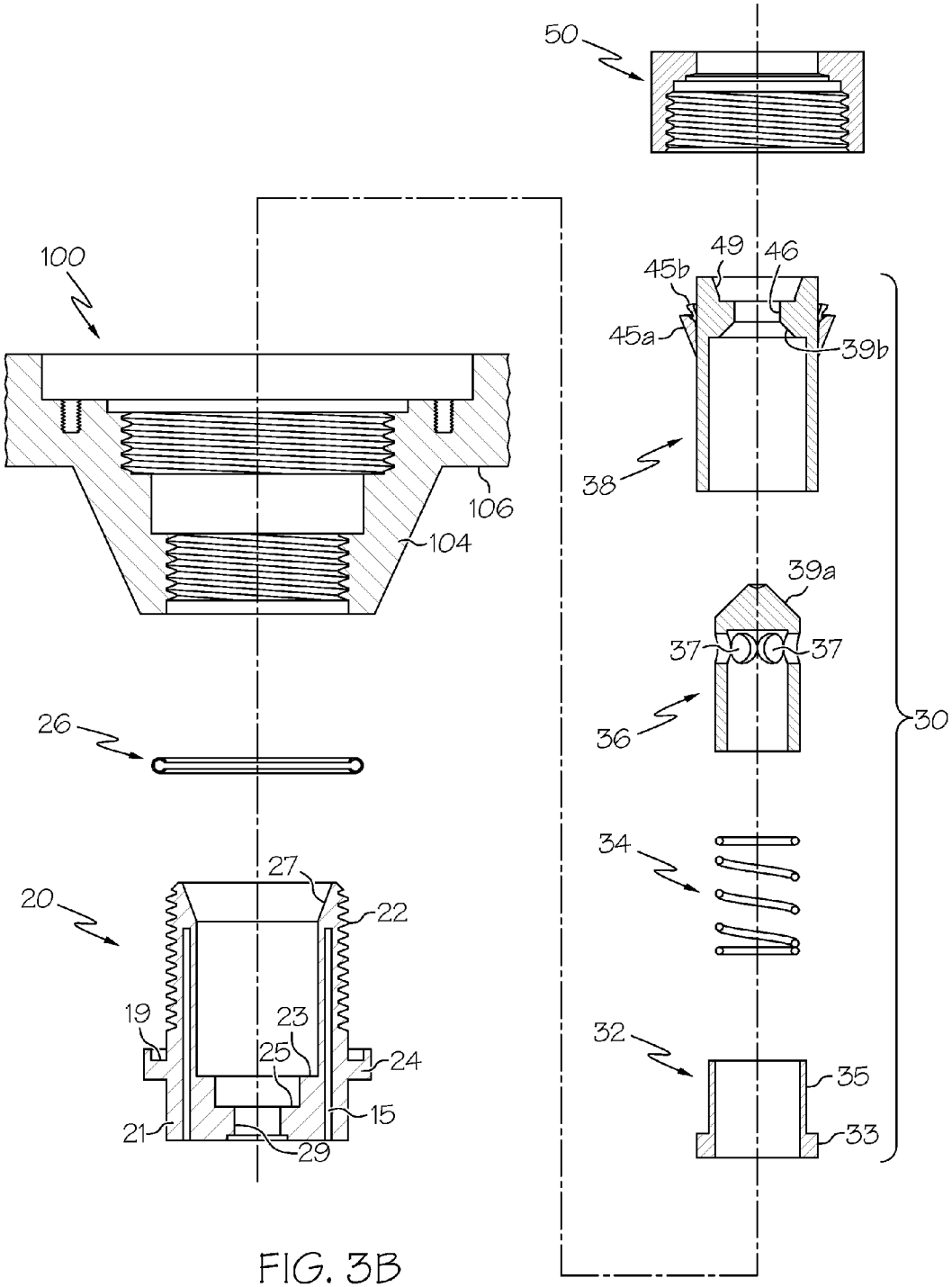
FIG. 3B is a centerline exploded view of the valve and wall according to the embodiment shown in FIG. 2B.

An alternative embodiment is shown in FIGS. 2B and 3B. In this embodiment the locking nut 28 is omitted. Instead, the side wall 44*e* defining the small through bore at the center of the stepped bore 40 has female threads that are complementary to the male threads on the outer surface 22 of the valve body 20. Such female threads can be provided in a conventional manner, e.g. via tapping the through bore after it is drilled. The valve body 20 is inserted into that threaded bore such that the respective male and female threads engage one another. Tightening is achieved by screwing the valve body 20 into the wall 102, e.g. using a wrench to engage the hex head 21. This embodiment may be desirable for very high-pressure applications because the threaded engagement between the side wall 44*e* and the valve body 20 can provide a reliable high-pressure leak-tight seal. If desired, PTFE tape, vacuum grease or other conventional thread sealants may be utilized in a conventional manner to promote a threaded seal. It may be further desirable to utilize complementarily tapered threads to facilitate forming such a seal; e.g. pipe threads such as conventional NPT-pipe threads. One potential disadvantage to this embodiment is that any internal structure connected to the valve body 20, e.g. any tubing connected in fluid communication with the exit port 29 of the valve 10, will need to rotate with the valve body 20 as it is tightened in the hull wall 102. This can be addressed either by waiting to connect such tubing to the valve 10 until the valve body 20 is installed, or by connecting it via a rotatable bearing-style fitting.

In the embodiments described here where sealing is achieved at a threaded engagement between the valve body 20 and the side wall 44*e*, the flange 24 and associated valve-body seal 26 can be omitted, though this may be less preferred. When the flange 24 and seal 26 are present, the male threads at the outer surface 22 of the valve body 20 can be dimensioned and positioned to achieve a seal within the range of compressibility of the valve-body seal 26 once it contacts the mating surface 105. In this manner the seal 26 may provide a redundant seal, which may be desired for additional safety. Even in embodiments where a threaded connection provides the fluid-tight seal between the valve body 20 and the hull wall 102, the valve-body seal 26 is desirable to ensure and maintain a tight contacting fitment between the valve body 20 and hull wall as their respective materials expand and contract at different rates based on thermal cycling between cryogenic and ambient temperatures. In this manner, the valve-body seal 26 can act as a redundant fluid-tight seal, at least against a moderate pressure drop across the hull wall 102, for example if unmatched thermal expansion causes the threaded seal between the valve body 20 and the wall 102 to become compromised as a result of thermal cycling.

Once the valve body 20 is secured to the hull wall 102 at rib 104, the internal components of the valve 10 are inserted into the valve body 20 through the wall 102 from its outer surface 108. As noted above, the valve body 20 has a valve-body bore to receive and accommodate those components. The bore of the valve body 20 extends from a tapered mouth 27 at its upper end to an exit port 29 at its lower end. In the illustrated embodiments, the valve-body bore has a first shoulder 23 and a second shoulder 25 disposed successively nearer to the lower end of the valve body 20, which define the lower terminal ends of successively-narrower partially-blind bores in the valve body 20. The inner diameter of the second shoulder corresponds to the diameter, and surrounds the mouth, of the exit port 29. Once the valve body 20 has been installed in the hull wall 102, tubing or piping can be used to connect the exit port 29 to whatever internal apparatus (e.g. a storage tank) within the hull 100 is to be supplied with fluid through the valve 10. The installation and use of such tubing or piping is well within the capability of one having ordinary skill in the art. For example, the exit port 29 may include or be fitted with appropriate connections or mating structure to connect tubing or piping; e.g. quick-release fittings, threaded fittings, fittings utilizing ferrules and/or gaskets to achieve a seal, or any other conventional or suitable fluid-tight connections.

In the illustrated embodiment, the internal components of the valve include a cylindrical spacer 32, a spring 34, a poppet 36 and a sleeve 38. These components together cooperate to form a component cartridge 30 that can be removably and replaceably installed in the valve body 20 through its mouth 27 and held in place via a resealable cap 50 (described below). Turning to the elements of the component cartridge 30 in the illustrated embodiment, the spacer 32 has an outwardly-extending flange 33 at its base extending radially outward from the outer surface 35 of the spacer 32 above the flange. The flange 33 diameter corresponds to the outer diameter of the first step 23 in the valve-body bore, such that the spacer 32 is slidably received against and rests on the first step 23 upon insertion in the valve body 20. The spacer 32 has a through bore whose inner diameter is complementary to the outer diameters of, and which therefore slidably receives, both the spring 34 and the poppet 36. The spring 34 is inserted therein until its base end rests against the second shoulder 25 of the valve-body bore (when installed therein), and the poppet 36 is inserted so that its base rests on the upper end of the spring 36. In this manner, movement of the poppet 36 is constrained to a fluid vertical translation along the common longitudinal axis of the spacer 32 and the poppet 36 in use; i.e. downward against the compressive action of the spring 34 and upward as a result of said action. The poppet 36 is also substantially cylindrical, having a blind bore open to the lower end thereof (facing the spring 34), with at least one (preferably a plurality of) lateral opening(s) 37 through the side wall thereof, preferably in an upper portion the poppet's side wall. The upper end of the poppet 36 preferably has a tapered (e.g. frustoconical) form that provides a first mating surface 39*a* on the outside of the poppet 36 for sealing the valve 10, above where the lateral opening(s) 37 is/are located.

The sleeve 38 has a partially-blind bore therein, which is open to the lower end of the sleeve 38 and terminates toward its upper end in a tapered (e.g. countersunk), downward-facing valve seat, which is adjacent (preferably surrounding) an inlet port 46 for the valve 10. An upward-facing fill-tube seat 49 is provided adjacent, preferably surrounding, the inlet port 46 on the opposite side of the wall that defines the inlet port 46, to accommodate and mate with a fill tube as described more fully below. The valve seat provides a second mating surface 39*b* for sealing the valve 10. The first and second mating surfaces 39*a* and 39*b* are complementary to one another such that when the poppet 36 is urged against the valve seat a fluid-tight seal is formed that closes off the inlet port 46 and inhibits or prevents the passage of fluid therethrough. Preferably, the mating surfaces 39*a,b* include or are provided with a PTFE coating to facilitate or ensure a fluid-tight seal between them when they are in contact in the valve-closed position. The partially-blind bore in the sleeve 38 has an inner diameter somewhat larger than the outer diameter of the poppet 36, to thereby provide an annular fluid space 43 therebetween to accommodate the flow of fluid past the valve seat and through the opening(s) 37 when the valve is open. Front and back ferrules 45*a* and 45*b* are also provided surrounding the sleeve 38 in an upper region thereof.

To assemble the valve 10 as shown in the illustrated embodiment the following methodology may be employed. With the component cartridge 30 installed in the valve-body bore (with the sleeve 38 fitted over the poppet 36 such that the first and second mating surfaces 39*a* and 39*b* are in contact), the cap 50 is fitted over the sleeve 38 and urged downward, against the compressive action of the spring 34, until the front ferrule 45*a* is seated against the tapered mouth 27 of the valve-body bore. Preferably, in this position the sleeve's cylindrical lower portion is received slidably in an annular space defined between the outer surface 35 of the spacer 32 and the inner surface of the valve-body bore, with the sleeve's 38 lower terminal end resting on the flange 33 of the spacer 32. The cap 50 is secured to the upper portion of the valve body 20, preferably via a complementary threaded engagement. The cap 50 can be tightened down against the ferrules 45*a,b*, which when compressed together will help secure the cap 50 in place in a conventional manner and provide a seal that will prevent fluid from entering between the outer surface of the sleeve 38 and the valve-body bore through the cap 50.

Optionally, the spacer 32 and sleeve 38 can be secured to one another (e.g. as by welding, a threaded connection or other suitable or conventional mode) and supplied with the spring 34 and poppet 36 disposed therein to provide a pre-assembled component cartridge 30 that may be replaced as a single unit. Such a pre-assembled component cartridges 30 could be manufactured and supplied separately to be replaced as a whole, e.g. at specified service intervals based on conditions that may be set by the manufacturer. Alternatively, this embodiment enables readily supplying a range of pre-assembled component cartridges 30 that may be useful for a variety of different applications; e.g. with different cracking pressures, temperature and/or chemical tolerances, made from different materials based on specified in-service conditions, etc. Alternatively, the spacer 32 and sleeve 38 can be one unitary body formed or machined from a single piece of material. Separate construction and post-assembly of the spacer 32 and sleeve 38 may be preferred, however, because such construction can be achieved by usual drilling and countersinking techniques. If the spacer and sleeve 38 are to be made of a single unitary structure, then the annular fluid space 43 will need to be machined into the interior wall of the combined spacer/sleeve 32/38 element via an internal-machining technique, above the lower portion of that surface that provides fluid sliding engagement of the poppet 36.

As noted above, the aforementioned internal components of the valve 10 cooperate and together comprise a component cartridge 30 that is removably inserted and received in the valve body 20 through its mouth 27. In the illustrated embodiment the component cartridge 30 includes the aforementioned components arranged and structured as herein described; i.e. using a spring that biases a vertically-translatable poppet 36 against a valve seat in normally-closed configuration. But this is only one preferred embodiment. Broadly speaking, the component cartridge 30 includes structure that is actuable to reversibly open and close a fluid pathway through the valve for the transport of fluid. Whatever its particular configuration, the component cartridge 30 can be assembled together initially and then inserted in the valve-body bore as a unitary assembly of multiple components, or those components can be inserted individually into the valve-body bore to assemble the valve 10. The precise number, arrangement and structure of the internal components is not critical. What is desirable is that the component cartridge 30, whatever its precise configuration, can be removably and replaceably installed in the valve body 20, e.g. via a resealable cap 50 that holds the cartridge 30 in place, without disturbing the valve body 20, the wall 102 in which it is installed or the enclosure (if any) of which the wall 102 forms a part. Preferably, the component cartridge 30 is configured so that the reversible opening and closing of the fluid pathway through the valve 10 is actuated or actuable from outside the valve 10 itself; e.g. using an actuation device (which can be a part of a filling assembly 205—described below) that is installed and present at a facility where fluid is to be delivered to and through the valve 10.

Alternatively to providing a separate valve body 20 that is to be installed in a wall 102, the valve body 20 itself may be integrated (e.g. machined) directly into the hull wall 102 so that no separate valve body 20 need be secured to the wall 102. In this embodiment, the valve-body bore, including its tapered mouth 27, successive shoulders 23,25 and exit port 29, can all be machined directly in the wall 102, replacing at least the lower-most inner surface 44*e* and step 42*d* in the stepped bore 40. A threaded portion adapted to receive and mate with the cap 50 can also be machined from the wall material. This embodiment has the advantage that it will not require installation of a separate valve body 20, which may be made from a different material than the hull 100, resulting in unmatched thermal expansion from thermal cycling. However, one potential disadvantage stems from the fact that wetted valve components preferably will be made from stainless steel, different from the preferred hull material of aluminum. In this embodiment there may be a variety of valve internal components 30, as well as the cap 50, made from stainless steel, which will be mismatched to the valve-body bore in terms of thermal-expansion characteristics. In the earlier embodiments, all of these components were made of the same material, preferably stainless steel, and thermal-expansion mismatch with the hull 100 was damped by a valve-body seal 26. Such would not be the case in the present embodiment, where the valve-body bore and at least some components of the component cartridge 30 will now be thermally mismatched, and therefore subject to expansion and contraction at different rates on cycling between cryogenic and ambient temperatures. For this reason, this embodiment may be less preferred in applications that will exhibit substantial thermal cycling, e.g. between cryogenic and ambient temperatures.

As seen in FIGS. 2A-2B, the fully-assembled valve 10 is fully recessed within the bore 40 in the hull wall 102, such that it does not protrude above the outer surface 108 of the hull 100. When it is not in use, a cover plate 90 can be secured over the valve 10 via conventional fasteners (e.g. bolts as shown). In the illustrated embodiments, the upper-most partially-blind bore of the stepped bore 40 is dimensioned to accommodate and receive the cover plate 90 therein. A cover gasket 92 is seated on the step 42*b* and compressed thereagainst by the cover plate 90 when the latter is secured to seal the interior of the bore 40, and the valve 10 components, from the outside environment. Alternatively, the cover gasket 92 can be replaced or complemented with an O-ring gasket around the outer diameter of the cover plate 90 (not shown), to seal its outer circumferential surface against inner wall surface 44*a*. The cover plate 90 optionally and preferably has an outer (upper) surface whose contour follows that of the outer surface 108 of the wall 102 in order to minimize aerodynamic or hydrodynamic drag as the hull 100 moves through a fluid such as air or water.

FIGS. 4-5 illustrate a filling assembly 205 that can be used to deliver fluid to the valve. The assembly 205 includes a fluid tee 210 with a fill tube 220 connected to and extending from one of the vertical branches of the tee. The terminal end 230 of the fill tube 220 preferably has an outer surface that has been machined to a taper in order to provide a seal surface 240 thereof. The seal surface 240 at the terminal end of the fill tube is complementary to the fill-tube seat 49 on the sleeve 38 of valve 10 (discussed above), such that a fluid-tight seal can be achieved when the fill tube is seated therein as will be more fully described.

An elongate plunger 250 enters the tee from the opposite vertical branch and extends through the branch to which the fill tube 220 is connected. The plunger 250 further extends through the fill tube 220, with a terminal end 260 of the plunger 250 issuing from the end of the fill tube 220. An actuator 270 is connected to or formed integrally (or cooperates) with a proximal end of the plunger 250. The actuator 270 can be used to control the degree to which the terminal end 260 of the plunger extends out from the end of the fill tube 220, in order to control opening of the valve 10 as will be more fully described.

A delivery tube 280 is connected to the lateral branch of the tee 210, through which a fluid that is to be sent through the valve 10 can be delivered. As will be appreciated, the vertical and lateral branches of the tee are in fluid communication so that fluid delivered via the lateral branch will flow through the fill tube 220. It is desirable, however, that fluid from the lateral branch of the tee not be permitted to flow, or at least that it is inhibited against flowing, through the vertical branch from which the plunger 250 enters the tee 210. Accordingly, the plunger 250 preferably is fed into the tee 210 via a plunger fitting 255 that provides a zero- or near-zero-tolerance fit for the passage of the plunger 250 therethrough, as seen in FIG. 4D. The plunger fitting 255 can be, e.g., a pipe/tube cap fitted to the tee branch via a conventional threaded connection, which has a through bore therein dimensioned to precisely accommodate the diameter of the plunger 250. If desired, vacuum grease may be used to facilitate or enhance the seal between the plunger 250 and the fitting 255. Alternatively, as seen in FIG. 4E a bearing seal 256 may be used. In this embodiment, a bearing seal 256, e.g. made from PTFE (such as Teflon®) is disposed at the opening of the tee branch where the plunger enters and is held in place by a cap 257. A bore is provided through the bearing seal 256 to accommodate the plunger 250 via an interference fit such that the seal 256 material presses and seals against the plunger 250, thereby inhibiting or preventing fluid from passing between them.

In certain embodiments, and particularly those in which the filling assembly 205 will be used to deliver a cryogenic fluid to the valve, it will be desirable to thermally insulate the delivery tube and the fill tube 220, and also to minimize conductive heat transfer through the plunger 250, which will contact the cryogenic fluid within the fill tube 220. Still referring to FIGS. 4 and 5, one or several insulating or jacketing elements can be used for this purpose. For example, A plunger sleeve 300 can be disposed around and surrounding a proximal portion of the plunger 250 above the tee 210. The plunger sleeve 350 is mated (e.g. fixed) to an insulating block 315 that encloses the tee 210, and extends from the block 315 concentric with the vertical branch of the tee through which the plunger 250 enters. Preferably, the plunger sleeve 300 is substantially hollow and possesses minimal thermal contact with the plunger 250 extending through its center, to thereby minimize thermal conduction between them.

In the illustrated embodiment, a plurality of O-rings 290 are disposed between the circumferential wall of the plunger 250 and the inner wall of the plunger sleeve 300 at a location adjacent the proximal end of the sleeve 300 just below where the plunger 250 enters the sleeve 300. These O-rings 290 not only stabilize lateral displacement of the plunger 250 and facilitate smooth rotation thereof, they also provide redundant seals against the leakage of fluid delivered via the delivery tube 280 that may escape past the fitting 255 (FIG. 4D) or bearing seal 256 (FIG. 4E). If desired, the O-rings 290 can be seated in associated grooves (not shown) machined circumferentially in the inner wall of the plunger sleeve 300. Because these O-rings 290 provide a thermal-conductive pathway between the sleeve 300 and the plunger 250, they are located as remote from the tee 210 as possible. The length of the plunger 250 (and the associated plunger 300) can be selected to provide a desired amount of thermal mass in the plunger 250 between their point of contact and a point where the plunger 250 contacts cryogenic fluid, so as to minimize thermal conduction therebetween to a desired degree.

The plunger 250 extends downward through the plunger sleeve 300, into and through a first vertical branch of the tee 210, through the opposite vertical branch thereof and through the fill tube 220, with its terminal end 260 issuing from the terminal end 230 of the fill tube 220. A portion of the plunger 250, preferably located immediately below or adjacent the O-rings 290, can be threaded with threads 252 that cooperate with complementary threads extending from a threaded bearing 305 disposed in the annulus between the inner wall of the plunger sleeve 300 and the plunger threads 252. This way, rotation of the plunger 250 results in a corresponding and precisely-controlled vertical displacement of the plunger 250. In this embodiment, the actuator 270 may simply be a handle. By rotating the actuator 270 at the proximal end of the plunger 250, the degree to which the terminal end 260 thereof emerges from the fill tube 220 (to engage the valve poppet 36 in use) can be precisely controlled. The threaded bearing 305 preferably is made from a low-conductivity material; e.g. a ceramic material. In an alternative embodiment, the actuator 270 can be or comprise a solenoid, which when energized can urge the plunger 250 downward so that its terminal end 260 emerges a desired degree from the fill tube 220. In further alternatives, pneumatic or hydraulic actuation of the plunger 250 may be utilized. In such embodiments, a threaded bearing 305 as illustrated may not be required.

The distal end of the plunger sleeve 300 is preferably mated to an upper surface of the insulating block 315, e.g. via a threaded connection as illustrated. The insulating block 315 preferably is itself hollow. The tee 210 can be suspended at the center of the block 315 via its connections to the plunger 250, delivery tube 280 and fill tube 220 via their respective fittings. Alternatively, if thermal losses at the block itself 315 are not a significant concern the block 315 can be a solid block of metal, e.g. stainless steel, and the tee 210 at its center can be formed by machining (e.g. as by drilling) directly in the block 315.

Preferably, a fill sleeve 310 extends from the lower surface of the tee 210, concentric with and surrounding the fill tube 220. The fill sleeve 310 can be connected to the block 315 in similar fashion as the plunger sleeve 300 described above. Analogous to the plunger sleeve 300, fill sleeve 310 also preferably is hollow and has minimal thermal contact with the fill tube 220 as it extends along a partial length of the fill tube 220. Optionally, the fill tube 220 can be connected to the fill sleeve 310 via a weld located at the terminal end of the fill sleeve 310 from which the fill tube 220 emerges. This weld, together with the fitting connection of the fill tube 220 to the tee 315, stabilizes and centers the fill tube 220 at the center of the fill sleeve 310. Alternatively or in addition, conventional low-conductivity spacers could be used to center and stabilize the fill tube 220.

The delivery tube 280 is itself preferably a length of vacuum tubing having a central fluid passageway that is suspended at the center of a tubular vacuum jacket via spacers, as known in the art. This vacuum tubing itself can be provided within a vacuum sleeve analogous to the plunger and fill sleeves 300 and 310 (not shown), which can be mated to the insulating block 315 in a similar manner. Alternatively, a terminal portion of the tubular vacuum jacket surrounding the delivery tube 280 can itself be mated, e.g., threaded, to the block 315 as shown in FIG. 4D. The tube 280 extends into the block 315 and is fitted to the lateral branch of the tee 210 via a suitable fitting. In either case, it is desired that the insulating block's interior volume be closed off from the ambient environment to enable a vacuum to be drawn therein as will be further described.

A mating sleeve 320 having partially-blind bore therein is slidably fitted over the fill sleeve 310, with the latter received through the opening at the partially-blind end of the mating sleeve. The mating sleeve 320 can extend down and over the terminal end 230 of the fill tube 220 when it is slid down along the outer surface of the fill sleeve 310. Optionally and preferably, the mating sleeve 320 opening is sealed against the outer surface of the fill sleeve 310 via an O-ring 325 to provide a vacuum-tight seal therebetween to facilitate drawing a vacuum on their combined interior volume during use as discussed below. Particularly when the valve 10 will be used to deliver cryogenic fluids, the O-ring 325 is located at the highest practical point along the interface between the mating sleeve 320 and fill sleeve 310, e.g., in a recess within the mating sleeve 320 as shown. This is so O-ring 325 may be as far as practical from the cryogenic fluid in use, so that it may be at a temperature as close to ambient as possible to facilitate its vacuum-sealing function.

The mating sleeve 320 has a mating flange 330 extending radially outward at the lower end thereof, optionally with a plurality of bolt holes therein for securing the same to the hull 100 when the filling assembly 205 is fitted to a valve 10 to deliver fluid. A positioning nut 350 is fitted to the fill tube 220 in order to secure the fill tube 220 and with it the rest of the filling assembly 205 to a valve 10 in order to deliver a fluid thereto. The positioning nut 350 has a downward-open partially-blind bore with an opening at the top whose diameter complements the outer diameter of the fill tube 220 so that the positioning nut 350 can translate smoothly along the length of the fill tube 220 as well as rotate smoothly about their common longitudinal axis. The fill tube 220 has a positioning collar 352 secured to the outer circumferential surface thereof adjacent the terminal end 230 of the tube 220. The collar 352 is secured on the tube 220, e.g., via welding or reverse threading. The positioning collar 352 extends radially outward from the outer surface of the fill tube 220, and has an upper shoulder 353 that engages the portion of the positioning nut 350 that defines the bore through which the fill tube 220 is slidably received. The positioning nut 350 has engagement structure that is adapted to cooperate with complementary engagement structure associated with the valve 10 in order to secure the filling assembly to the valve 10 in use. In the illustrated embodiment, the positioning nut 350 is male-threaded along the lower terminal portion of its outer circumferential wall. These male threads cooperate with and engage complementary female threads in side wall 44*c* of the stepped bore 40 of the hull wall 102 in order to secure the filling assembly 205 to the valve 10 for delivery of a fluid thereto.

As seen in FIGS. 2A-2B the valve 10 has a normally-closed configuration, wherein the mating surfaces 39*a,b* between the poppet 36 and the valve seat on sleeve 38 are normally engaged with one another by the compressive action of the spring 34 to prevent the passage of fluid. When not in use, e.g. with the cover plate 90 sealed thereover, the valve 10 remains normally-closed. When it is desired to deliver a fluid through the valve 10 to whatever internal apparatus is served thereby, the hull 100 is retrieved and the cover plate 90 removed.

Now referring to FIG. 6A, the filling assembly 205 is positioned over the exposed valve 10 recessed in the bore 40. The terminal end 230 of the fill tube 220 aligned with the fill-tube seat 49 on the sleeve 38. The mating sleeve 320 is withdrawn upward along the length of the fill tube 220 so the terminal end 230 of the fill tube 220 and the positioning nut 350 surrounding it are accessible to achieve the described alignment with the valve 10. The positioning nut 350 is fitted into the bore in the illustrated embodiment by mating with side wall 44*c* to establish a complementary threaded connection therebetween. The upper portion of the positioning nut 350, above the threads, preferably has a plurality of opposed lateral flat portions (e.g. a hex head), which can be engaged by a conventional wrench to tighten the nut 350 in the bore 40 against side wall 44*c*. As the nut 350 is tightened, it urges the fill tube 220 downward via engagement with the positioning collar 352, thereby compressing the seal surface 240 of the fill tube 220 against the fill-tube seat 49. The nut 350 is tightened until the desired fluid-tight seal between the surface 240 and seat 49 is achieved. Preferably, both the surface 240 and seat 49 are coated with or comprise a PTFE material to help facilitate the seal. Once the nut 350 has been sufficiently tightened, the mating sleeve 320 is slid down along the fill tube 220 until its mating flange 330 is received and seated in the bore 40 on the step 42*a*. If present, the bolt holes in mating flange 330 are aligned with corresponding bores in the surface of step 42*a*, to accommodate bolts or other fasteners to fix the mating sleeve 320 in place. A mating gasket 326 can be compressed between the mating flange 330 and the step 42*b* to provide a vacuum-tight seal therebetween. Alternatively, an O-ring can be disposed in the outer circumferential wall of the mating flange 330 (not shown) to engage the inner surface 44*a* to facilitate a vacuum-tight seal. With the mating sleeve 320 and positioning nut 350 fixed in the stepped bore 40, the filling assembly 205 is fixed in place relative to the valve and is ready for use.

As will be evident from the foregoing description and as seen in the drawings, the interior volumes of the fill sleeve 310, the insulating block 315, the plunger sleeve 300 and a delivery sleeve surrounding the delivery tube (if present) are all in fluid communication with one another, and closed off from the external environment, so that together they define a common evacuable space surrounding elements that will carry whatever fluid is to be delivered via the filling assembly, or that will be otherwise in thermal communication with such fluid. When the valve 10 is to be used to deliver, e.g., cryogenic fluids, a vacuum can be drawn on this common evacuable space. This is achieved by connecting a vacuum pump to the vacuum port 356 in the mating sleeve 320 and operating it until the desired vacuum is reached and maintained. Providing a vacuum in this common evacuable space will help insulate the internal components from ambient heat transfer into cryogenic fluids flowing through the filling assembly 205 and the valve 10. The vacuum need not be absolute, but the higher degree of vacuum the greater insulation against heat transfer into the valve while passing cryogenic fluids. In addition to providing thermal insulation to the valve 10 and fill tube 220, such a vacuum also will tend to hold the mating sleeve 320 in place. Accordingly, the mating sleeve 320 need not be secured to the hull 100 via bolts through the mating flange 330. However, such bolted attachment may nonetheless be desirable to provide a secure attachment.

As an alternative to the common evacuable space as above described, the weld between the fill sleeve 310 and fill tube 220 (see in FIG. 4) may close the lower end of the sleeve 310 such that it, the block 315, sleeve 300 and delivery tube 280 together define a separate common space that is maintained under vacuum, with the space inside the mating sleeve 320 being separately evacuable via the vacuum port 356.

To open the valve 10, the plunger 250 is advanced, e.g. by operation of the actuator 270, so that the terminal end 260 thereof is advanced below the terminal end 230 of the fill tube 220. As the terminal end 260 continues to advance, it engages an engagement portion of the poppet 36 at a location along its outer surface that is accessible through the inlet port 46 and aligned with its longitudinal axis, and presses it downward against the compressive force of the spring 34, thereby unseating the mating surfaces 39*a,b* from one another. In this manner, as seen in FIG. 6B a fluid channel is opened that provides fluid communication between the inlet port 46 and the exit port 29 via the annular fluid space 43, through the lateral opening(s) 37 and down through the blind bore within the poppet 36. Once the valve is opened in this manner, a fluid can be delivered from a source, through the delivery tube 280 (FIG. 4), through the fill tube 220, and through the valve 10 into whatever apparatus is fluidly connected to the exit port 29.

Delivery of fluid may continue until the desired volume has been delivered. Suitable sensors may be installed, e.g. within a storage tank being filled inside the hull 100, to provide an indication when sufficient filling has been achieved. When the filling operation is complete, the delivery flow can be turned off, and the plunger 220 withdrawn (e.g. via actuator 270) to restore the poppet 36 to the closed position, with mating surfaces 39*a,b* in contact and forming a seal. If a cryogenic fluid has been delivered through the valve, it may be desirable to wait a period of time after the cryogenic-fluid supply has been shut off, and perhaps even to vent the valve 10, so that at least the spring 34 can return to ambient temperature, or at least rise above cryogenic temperature, before withdrawing the plunger 220. In this manner, the spring 34 will be able to regain to at least a certain degree any elasticity that may have been lost while it was at cryogenic temperatures in contact with cryogenic fluid. Once the spring 34 has recovered to the desired temperature (if applicable) and the poppet 36 restored against the valve seat to re-seal the mating surfaces 39*a,b*, the mating sleeve 320 can be disconnected from the wall 102, the positioning nut 350 disengaged from within the bore 40 and the cover plate 90 replaced.

It is desired that all wetted components of both the valve 10 and filling assembly 205 be made from stainless steel, e.g. 316 stainless. Stainless steel provides a good compromise between cost and performance characteristics, and is able to withstand a wide range of in-service conditions, including cryogenic conditions. However, other materials of construction can be used; e.g. titanium, aluminum, as well as other metals and their alloys (or even plastic or composite materials) depending on the in-service conditions. It is also preferred, particularly for cryogenic in-service conditions, that all components except for the gaskets described above are made from the same metal. This ensures that all components of the valve 10 and the filling assembly 205 will share common thermal-expansion characteristics, which can be particularly beneficial when large swings in temperature will be experienced.

In cases when the disclosed system will be used to deliver cryogens, it also may be desired to provide thermal insulation around the delivery tube 280 and the fill tube 220. For example, the fill sleeve 310 itself may be made of an insulating material. Alternatively, the sleeve 310 may have an inner diameter sufficient to accommodate separate layers of thermal insulation wrapped around the fill tube 220 within the fill sleeve 310. Similar insulating structure can be provided around the delivery tube 280, as well. For example, a further fill sleeve may be disposed around the delivery tube 280 to enclose thermal insulation between it and the delivery tube. When used for cryogenic service, it is desirable that the plunger sleeve 300 have a sufficient length so that its temperature will be at or approaching ambient temperature at the location adjacent where the upper end of the plunger 250 emerges therefrom. This ensures not only that the operator does not risk coming into contact with potentially-damaging cryogenic temperatures, but also that the gaskets 290 will not have a tendency to become brittle. Ideally, the length of the plunger sleeve 300, and therefore of the plunger 250 itself, is sufficient that there is enough thermal mass in the plunger 250 between where it contacts cryogenic fluids and where it emerges from the upper portion of the plunger sleeve that any exposed portion thereof, as well as the actuator 270, will be at or approaching ambient temperature.

Among the benefits of the valve 10 described herein is that it is mounted recessed in the wall 102, and can be covered by a cover plate when not in use. Thus it does not extend above the outer surface 108 of the wall 102 and presents no exterior obstruction to the otherwise normal operation of the submersible vehicle or other device or apparatus of which the wall 102 forms a part. Another benefit is that the component cartridge 30 of the valve can be readily removed for service and/or replacement of individual components from outside the hull 100 by simply removing the cap 50. For example, in the illustrated embodiment it may be desirable to recoat the mating surfaces 39*a,b* with PTFE to ensure a continued fluid-tight seal. Alternatively, it may be desirable to replace the poppet 36 and/or sleeve 38 to ensure continued integrity of those surfaces 39*a,b*. It may further be desirable to periodically replace the spring 34, e.g. due to spring-constant losses resulting from repeated thermal cycling between cryogenic and ambient temperatures. Notably, in the illustrated embodiment removal of the cap 50 to access the component cartridge 30 does not impart any significant (and preferably none at all) rotational force on the poppet 36 and spring 34. The present construction enables ready removal, servicing and/or replacement of these and other components of the component cartridge 30 from outside the hull 100 without having to remove the valve body 20 therefrom, or to disassemble hull sections as may otherwise have been necessary to access the valve body 20 for removal. Any desired service of the valve internal components may be performed, and the valve 10 can be reassembled, without disturbing or exposing the interior environment within the hull 100. When replacing the internal components, it is desired that new ferrules 45*a,b* be used, and that the prior-used ferrules not be re-used.

Even though the disclosed design enables removal of the component cartridge and service of the valve internal components without removing the valve body 20 or disturbing the hull's 100 interior environment, as will be appreciated the valve body 20 also can be removed for service when desired, e.g. by unscrewing the same from the underside of the wall 102. It is contemplated, however, that typical servicing of the valve 10 will primarily involve the repair/replacement of internal components such that removal of the valve body 20 will not typically be required while the hull 100 is in service. The service interval for the valve body 20 itself, if any, could be longer and timed to coincide with a period of time when the hull 100 is not in service and not soon to be returned to service.

The valve 10 herein disclosed also enables replenishment of fluid stores, or delivery of fluid, through the wall 102 without exposing the interior environment of the hull 100 while it remains in service. The filling assembly 205 can be coupled to the valve 10 to deliver a fluid thereto, and ultimately to a storage tank or other apparatus within the hull 100, without exposing the interior environment of the hull 100 to the outside environment. For example, a vacuum or other regulated or controlled atmosphere within the hull 100 can be maintained while refilling storage tanks with liquid cryogens or other fluids via the valve(s) 10 in the hull wall 102. Once refilling is complete, the filling assembly 205 is disengaged, the cover plate 90 is replaced and the hull 100 is again ready for immediate service without reconditioning its interior environment due to exposure to the outside. Also, because the valve 10 is housed within the wall 102 of the hull 100, it does not displace any significant volume within the hull 100 not already taken up by the rib 104, which volume instead can be used for equipment or additional storage-tank volume useful for the hull's mission. This represents an improvement over conventional undersea-vehicle configurations wherein a refilling valve is located underneath a hand-hole cover in the hull wall 102, taking up space that could be better utilized with mission-specific equipment. By recessing the valve 10 entirely within the hull wall 102, and particularly within the rib 104 of the wall 102, the disclosed valve 10 does not extend within the volume of the hull 100.

Moreover, the disclosed embodiments enable actuation of the valve 10 using an external filling assembly 205, such that valve-actuation structure (for dissociating the mating surfaces 39*a,b* so that fluid can flow through the valve) need not be incorporated, or space provided for it, in the hull 100 or the hull wall 102. Valve actuation is achieved entirely outside the hull 100 and the associated actuation hardware, e.g. incorporated with or integrated into the filler apparatus 205, can be provided as part of the facility hardware for mating with and delivering fluid to a valve 10, instead of onboard with the valve 10 itself.

Referring again to FIGS. 1A-1B, a plurality of valves 10 as disclosed herein can be provided circumferentially along and in a rib 104 of the hull wall 102. For example, to fill an enclosed tank within the hull 100, in addition to a filling conduit for delivering fresh fluid it may be necessary to provide a vent conduit to expel displaced gas as new liquid is delivered. Accordingly, it is contemplated that in the case of a storage tank inside the hull of a submersible vehicle, the storage tank preferably will be connected to two valves as described herein, one of which can be used to deliver fresh fluid and the other of which can be used as a vent while filling. Multiple pairs of valves 10 as herein described can also be provided, again as seen in FIG. 1A, e.g. to serve as paired fill- and vent-valves for multiple internal storage tanks, as well as to deliver fluids to other apparatus within the hull 100.

The foregoing description has assumed that the valve 10 is mounted in the wall 102 of an enclosure, such as a hull 100. However, the valve 10 could be equally installed through any wall wherein it is desired to deliver a fluid to apparatus on one side of the wall from a source located on the opposite side. Accordingly, the wall 102 need not necessarily be that of an enclosure. While the valve 10 will have clear application where the wall through which fluid-delivery is desired is metal, the valve 10 could be installed in a wall made from other material, or even from composite materials, provided the wall material has the strength to support mounting of the valve as described.

Although the invention has been described with respect to certain preferred embodiments, it is to be understood that the invention is not limited by the embodiments herein disclosed, which are exemplary and not limiting in nature, but is to include all modifications and adaptations thereto as would occur to the person having ordinary skill in the art upon reviewing the present disclosure, and as fall within the spirit and the scope of the invention as set forth in the appended claims.

What is claimed is:

1. A submersible vehicle comprising:

a hull comprising a hull wall having inner and outer wall surfaces on opposite sides of said wall;

a wall bore in said wall extending between and open to said inner and outer wall surfaces; and a valve installed in said wall bore, said valve comprising an inlet port accessible through said wall bore from outside said hull and an exit port accessible from inside said hull, said valve being recessed in said wall bore so that said valve does not extend above said outer wall surface, said valve being actuable through said inlet port to reversibly open and close a fluid pathway for transport of fluid through said valve said valve comprising a valve body that is secured to said hull wall in said wall bore, said valve body having a valve-bodybore with a mouth at a first end, said mouth open toward said outer wall surface, and a component cartridge removably installed in the valve-body bore through said mouth, said component cartridge comprising said inlet port and being actuable to reversibly open and close a fluid pathway for transport of fluid through said valve and thereby through said hull wall.

2. The vehicle of claim 1, said valve body having an exit port of the valve at a second end of the valve body, an outer surface of said valve body being threaded adjacent said first end thereof.

3. The vehicle of claim 2, said valve body having and a flange extending radially from said outer surface thereof at a location adjacent said second end.

4. The vehicle of claim 2, further comprising a removable cap in threaded engagement with said first end of said valve body to secure said component cartridge in place.

5. The vehicle of claim 1, said component cartridge comprising a poppet having a first mating surface and a valve seat having a second mating surface, said poppet being translatable along a longitudinal axis from a closed position, wherein said first and second mating surfaces contact one another to thereby close said fluid pathway, to an open position, wherein said first and second mating surfaces are separated from one another to thereby open said fluid pathway.

6. The vehicle of claim 5, said poppet being biased in said closed position.

7. The vehicle of claim 5, said poppet having an engagement portion on an outer surface thereof that is aligned with said longitudinal axis and is accessible through an inlet port of said valve, and being configured to be engaged by a plunger inserted through said inlet port to actuate said poppet between said open and closed positions.

8. The vehicle of claim 1, said wall having a first region with a first thickness between said first and second wall surfaces, and a second region with a second thickness, greater than said first thickness, between said first and second wall surfaces, said wall bore being disposed in said second region.

9. The vehicle of claim 8, said second region comprising a rib extending above an expanse of said second wall surface located adjacent the rib on the second side of said wall.

10. The vehicle of claim 9, said wall being a cylindrical wall, said second wall surface facing a longitudinal axis of said cylindrical wall, said rib being circular and projecting radially inward toward said axis.

11. The vehicle of claim 10, said rib having a tapered cross-section taken along a plane that bisects said cylindrical wall along its axis, said tapered cross-section being widest at a base of said rib and narrowing as the rib projects radially inward.

12. The vehicle of claim 10, said rib having a trapezoidal cross-section taken along a plane that bisects said cylindrical wall along said axis.

13. The vehicle of claim 1, said valve body being secured to said wall via a threaded connection between an outer surface of said valve body and a side wall of said wall bore.

14. The vehicle of claim 1, said valve body comprising a valve-body flange extending radially from an outer surface thereof, said valve body being inserted through said wall bore from the second side of said wall so that said valve-body flange is disposed adjacent the second wall surface, and a valve-body seal between said valve-body flange and said second wall surface, wherein a nut is disposed in said wall bore and threaded over said valve body, said nut abutting and being tightened against a surface in said wall bore such that said valve-body seal is compressed between the valve-body flange and the second surface of the wall.

15. The vehicle of claim 14, said valve-body seal comprising a metal C seal.

16. The vehicle of claim 1, said valve body further comprising an annular evacuable space open to an inward end of the valve body and being in fluid communication with an interior volume of said hull and extending between said valve-body bore and an outer surface of said valve body, said interior volume and said evacuable space being under vacuum.

17. The vehicle of claim 1, said component cartridge being actuable by a plunger that engages said cartridge via said inlet port from outside said hull.

18. The vehicle of claim 1, further comprising a removable cap securing said component cartridge in place and at least one ferrule surrounding a portion of said component cartridge, said ferrule being compressed beneath said cap and providing a seal between said cap and said component cartridge.

19. The vehicle of claim 18, said at least one ferrule comprising a front ferrule and a back ferrule that are compressed together beneath said cap and cooperate to provide said seal.

20. A submersible vehicle comprising:

a hull comprising a hull wall having inner and outer wall surfaces on opposite sides of said wall, said inner wall surface defining an interior environment;

a wall bore in said wall extending between and open to said inner and outer wall surfaces; and a valve installed in said wall bore, said valve comprising an inlet port accessible through said wall bore from outside said hull and an exit port accessible from inside said hull, said valve being recessed in said wall bore so that said valve does not extend above said outer wall surface, said valve being actuable through said inlet port to reversibly open and close a fluid pathway for transport of fluid through said valve;

said valve configured such that removal of internal components thereof through the wall bore does not expose said interior environment to an exterior environment outside said vehicle.

21. The vehicle of claim 20, further comprising a removable cover plate installed over said wall bore at the outer wall surface of said hull, said cover plate having an outer surface that is substantially continuous with said outer wall surface so as to present minimal hydrodynamic drag as the vehicle moves through water.

22. The vehicle of claim 20, said hull comprising a rib extending above an expanse of said inner wall surface located adjacent the rib inside said hull.

23. The vehicle of claim 20, said valve further comprising a valve body secured in an opening through said hull wall, said internal components of said valve being serviceable without removing said valve body from said hull wall.

24. The vehicle of claim 20, said valve further comprising a valve body secured in an opening through said hull wall, said internal components of said valve being removable from said valve body without removing said valve body from said hull wall.

* * * * *

UNITED STATES PATENT AND TRADEMARK OFFICE

CERTIFICATE OF CORRECTION

PATENT NO. : 8,919,273 B1
APPLICATION NO. : 13/442361
DATED : December 30, 2014
INVENTOR(S) : Michael Hoffman and Bradley N. Stoops It is certified that error appears in the above-identified patent and that said Letters Patent is hereby corrected as shown below:

In the Specification

At line 35 of Column 6 correct "Tefloe-coated" to read "Teflon®-coated"

Signed and Sealed this
Fourteenth Day of April, 2015

Michelle K. Lee

Michelle K. Lee
*Director of the United States Patent and Trademark Office*